US009556631B2

(12) United States Patent
Brooks et al.

(10) Patent No.: US 9,556,631 B2
(45) **Date of Patent: *Jan. 31, 2017**

(54) SYSTEM AND METHOD FOR THE SELECTIVE REPAIR OF ROOFING SHINGLES

(71) Applicant: Shawn Brooks, Ft. Worth, TX (US)

(72) Inventors: Shawn Brooks, Ft. Worth, TX (US); Paul DeLand, Ft. Worth, TX (US)

(73) Assignee: Shaw Brooks, Ft. Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/951,246

(22) Filed: Nov. 24, 2015

(65) Prior Publication Data

US 2016/0076264 A1 Mar. 17, 2016

Related U.S. Application Data

(63) Continuation of application No. 14/486,989, filed on Sep. 15, 2014, now Pat. No. 9,222,272.

(60) Provisional application No. 61/878,143, filed on Sep. 16, 2013.

(51) Int. Cl.

| | |
|---|---|
| ***E04G 23/03*** | (2006.01) |
| ***E04G 23/02*** | (2006.01) |
| ***E04D 15/02*** | (2006.01) |
| ***E04D 7/00*** | (2006.01) |
| ***E04D 1/26*** | (2006.01) |
| *E04D 1/00* | (2006.01) |

(52) U.S. Cl.

CPC ..... *E04G 23/0281* (2013.01); *E04D 1/26* (2013.01); *E04D 7/005* (2013.01); *E04D 15/02* (2013.01); *E04D 15/025* (2013.01); *E04D 2001/005* (2013.01)

(58) Field of Classification Search

CPC ..... E04G 23/0281; E04D 15/02; E04D 7/005; E04D 15/025

USPC ..... 52/541.5, 741.3, 748.1

See application file for complete search history.

(56) References Cited

U.S. PATENT DOCUMENTS

| | | | | |
|---|---|---|---|---|
| 2,847,318 | A * | 8/1958 | Dowlen | E04B 1/62 118/308 |
| 3,617,329 | A * | 11/1971 | Goff | B05B 7/1409 106/282 |
| 4,146,672 | A | 3/1979 | Jasperson | |
| 4,256,804 | A | 3/1981 | Jasperson | |
| 4,745,032 | A | 5/1988 | Morrison | |
| 4,859,723 | A | 8/1989 | Kyminas et al. | |

(Continued)

*Primary Examiner* — Adriana Figueroa

(74) *Attorney, Agent, or Firm* — Hemingway & Hansen, LLP; D. Scott Hemingway

(57) ABSTRACT

The invention is primarily directed to a system and method of selectively repairing asphalt-based shingles having embedded granular material. The system and method of the invention also comprises the use of devices specifically designed and used to template repaired shingles and protect surrounding shingles from adhesives and a shingle frame device to aid in applying, leveling and compressing granules onto the damaged shingle. The system and method of the claimed invention comprises the steps of removal of debris from the damaged area, application of a base coat adhesive to the damaged area, embedding color-matched granules in the base coat and application of a top coat sealant that permanently bonds the repaired layers to the original roofing material.

26 Claims, 9 Drawing Sheets

(56) References Cited

U.S. PATENT DOCUMENTS

| | | | | |
|---|---|---|---|---|
| 5,230,738 | A * | 7/1993 | Wheeler | B05B 15/0456 118/504 |
| 5,622,023 | A * | 4/1997 | Crispino | E04D 15/07 239/130 |
| 6,122,891 | A * | 9/2000 | Carpenter | B26D 7/015 52/746.11 |
| 8,104,575 | B1 * | 1/2012 | Bancroft | E01C 9/086 182/45 |
| 8,277,881 | B2 | 10/2012 | Khan et al. | |
| 2007/0260011 | A1 | 11/2007 | Woods | |
| 2008/0066420 | A1 * | 3/2008 | May | B60N 2/60 52/741.3 |
| 2010/0192509 | A1 | 8/2010 | Sieling et al. | |
| 2011/0083391 | A1 | 4/2011 | Thomas | |
| 2011/0097485 | A1 * | 4/2011 | Breeden | B05B 7/1486 427/186 |
| 2012/0258282 | A1 * | 10/2012 | Hammond | C04B 26/26 428/143 |

* cited by examiner

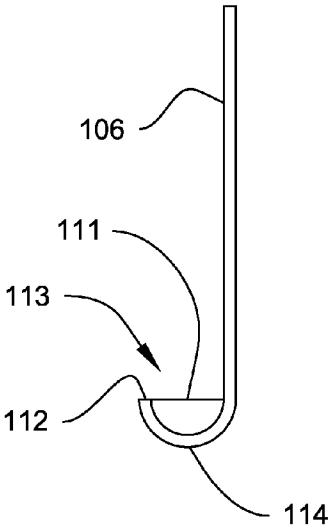
FIG. 4B
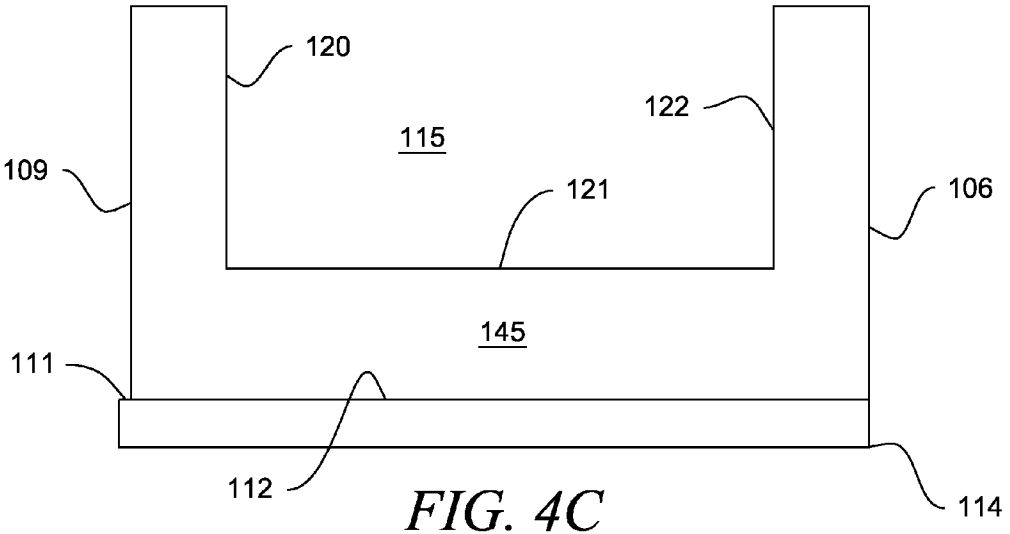
FIG. 4C
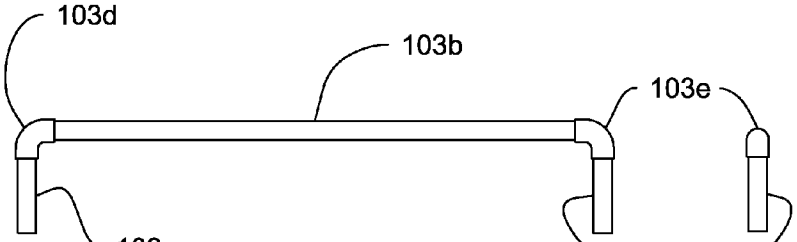
FIG. 5B
FIG. 5C
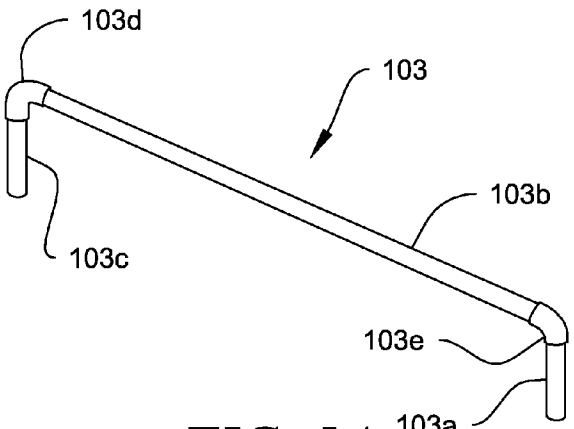
FIG. 5A

SYSTEM AND METHOD FOR THE SELECTIVE REPAIR OF ROOFING SHINGLES

CROSS REFERENCE TO RELATED APPLICATIONS

This is a Continuation application related to prior Utility application Ser. No. 14/486,989, issued on Sep. 15, 2014 as U.S. Pat. No. 9,222,272, which claims priority based on a Provisional Patent Application Ser. No. 61/878,143 filed on Sep. 16, 2013, and priority is claimed for this earlier filing under 35 U.S.C. §§119 and 120.

STATEMENT REGARDING FEDERALLY SPONSORED RESEARCH OR DEVELOPMENT

Not applicable.

TECHNICAL FIELD OF INVENTION

This invention relates to a system and method of selectively repairing roofing shingles.

BACKGROUND OF THE INVENTION

Asphalt based shingles are the most common roofing material used in the United States on residential and commercial structures. These asphalt shingles are composed of a thin and flat base material made of either paper or fiberglass, which is saturated with asphalt. Granular material is embedded on the upper surface of the asphalt saturated base material. The durability of these shingles is ranked by the warranted life of the materials, and the life span of such shingles can range from 5 to 50 years.

There are a number of ways an asphalt shingle can be damaged, and most of these damaging activities will result in the loss of protection to the underlying structure. These causes of damage include normal ageing of the shingle, mechanical damage from foot traffic, manufacturing defects such as blistering, and storm damage resulting from high winds, heavy rain, or hail.

Hail and similar weather-related damage is estimated to cause more than one billion dollars in roof damage nationwide each year. The type of roofing materials affected the most by hail damage is asphalt-based roofing shingles with embedded granules. Such hail damage to asphalt shingles may include: (1) dislodging the granular material on the top surface of the asphalt base, (2) causing indentions in the asphalt, or (3) puncturing a hole or gash into the asphalt shingle.

For weather-related damage, dislodging of the granular material on the top surface of the asphalt shingle may sound innocuous, but the resulting damage caused by dislodging the granular material is significant. The granules embedded on the top surface of an asphalt shingle have a two-fold purpose. While the granules provide color for the aesthetic appearance of the roof, the granules are essential to providing the durability of the roofing shingle by providing weather resistance and protection from ultra-violet (UV) radiation.

If granules are removed from the top surface of an asphalt shingle, the shingle will be more vulnerable to subsequent weather damage and increased UV radiation. Over time, increased UV radiation and heat applied by the sun against the unprotected shingle will cause the exposed asphalt areas under the top surface of the asphalt shingle to dry and crack.

A dry or cracked underlying asphalt shingle will likely lead to leak damage of the roof, and destruction of the roof sheathing residing under the shingles. Eventually, this type of damage will compromise the underlying housing structure.

When a portion of the roofing shingles on a roof become damaged (e.g. by high winds, hail damage, etc.), replacement of the entire roof is usually recommended. This is the normal recommendation even for relatively minor indentions if there is sufficient loss of granules over a predetermined area of the roof. The pre-determined area to measure roof damage is a square area on the roof, usually a square of 10 ft. by 10 ft. (100 sq. ft.). That 100 foot area has approximately 8 shingles sized approximately 12 inches wide by 36 inches long. An entire roof replacement is recommended if there are 8-12 significant hail strikes or indentations located within any given 10 ft. by 10 ft. square on the roof.

Entire roof replacement for this type of weather-related damage is responsible for the majority of roof-related insurance payouts by homeowner insurance companies in the United States. One of the consequences of this type of roof replacement is that approximately 22 billion pounds of shingles are deposited in landfills each year, even though many or most of those shingles are in a good or undamaged condition. There is an existing need for a method and system that can avoid the replacement of an entire shingled roof when only a portion of roofing shingles on the roof are damaged.

Existing roof and shingle repair options are very limited and such existing options produce unsatisfactory results. For example, sealants, by themselves, provide a short term stop to further damage, but since most sealants do not repair the damage to the shingle adequately. And, sealants, when used alone, do not restore the damaged shingle to its original condition, either functionally or aesthetically. Use of sealants, by themselves, to repair a roof shingle is unsatisfactory because the shingle is not protected against future weather or UV damage. Insurance companies do not accept repairs using only sealants as an acceptable replacement insurable roof. As such, insurance companies will not re-insure a roof that is repaired with only sealants because such repairs do not produce a long-term, satisfactory repair.

There exists a need for a means to repair damaged shingles on an existing roof without having to replace the entire roof, and there is a need for a roof shingle repair method that produces a fully functional shingle or shingles even if the roof previously had hail strikes, wind damage or other weather-related damage. There is also a need to repair selected roofing shingles in an acceptable and fully functional manner, with such repair being qualified and approved by insurance carriers. There is an overall need for an economical means of fully restoring a damaged roof shingle without replacing an entire roof.

SUMMARY OF INVENTION

The invention is primarily directed to a system and method of selectively repairing asphalt-based shingles having embedded granular material. The claimed system and method produces a roof shingle repair that restores selected portions of a roof or selected shingles to their original, or an improved, functionality while still providing an aesthetic match of the repaired area or the repaired shingle to the original and surrounding roofing material.

The claimed invention provides a system and method for repairing selected shingles on an existing roof so that the repaired roofing shingles are: (1) aesthetically indistinguishable from the remaining and surrounding un-repaired portion of the roof, (2) equal to, or having greater, impact resistant than the original roofing shingles, (3) more economically advantageous for both structure owners and insurance companies that address damaged roofing materials, and (4) not disposed of or deposited in landfills due to disposal of entire replaced roofs, which significantly reduces economic impact by reducing landfill waste.

The system and method of the invention also comprises the use of devices specifically designed and used to template repaired shingles and protect surrounding shingles from adhesives and to frame a shingle for repair to aid in applying, leveling and compressing granules onto the damaged shingle. In addition to the specialized devices, the system and method of the claimed invention comprises the steps of removal of debris from the damaged area, application of a base coat adhesive to the damaged area, embedding color-matched granules in the base coat and application of a top coat sealant that permanently bonds the repaired layers to the original roofing material.

BRIEF DESCRIPTION OF THE DRAWINGS

The objects and features of the invention will become more readily understood from the following detailed description and appended claims when read in conjunction with the accompanying drawings in which like numerals represent like elements and in which:

FIG. 4B is the side view of the base plate in the adjustable shingle frame, and FIG. 4C is a top side view of the base plate in the adjustable shingle frame, FIG. 5A is the perspective view of the slide bar of the adjustable shingle frame, FIG. 5B is side view of the slide bar in the adjustable shingle frame, and FIG. 5C is front view of the slide bar in the adjustable shingle frame.

DETAILED DESCRIPTION

Hail strikes, wind, and foot traffic can cause indention damage to a roof shingle, split damage in the top surface of a roof shingle, and dislocation damage to roofing shingles by dislodging embedded granules from the top surface of the roof shingle. The invention is primarily directed to a system and method of selectively repairing asphalt-based shingles having embedded granular material. The invention can also be used with composition shingles, metal roof systems, and decorative roofing materials such as stone-coated metal.

The claimed invention provides a system and method for repairing selected shingles on an existing roof so that the repaired roofing shingles are: (1) aesthetically indistinguishable from the remaining un-repaired portion of the roof, (2) of equal, or greater, impact resistance than the original un-repaired roofing shingle, (3) more economical because there are significant cost savings achieved by for both structure owners and insurance companies from using the present invention, and (4) reduce environmental damage by reducing the amount of roofing materials that must be deposited in landfills from the disposal of entire replaced roofs. The present invention produces a selective roof repair that restores selected portions of a damaged roof to its original or improved functionality, while still producing an aesthetic match of the repaired area to the original roofing material.

The system and method of the claimed invention comprises the steps of removal of debris from the damaged area, application of a base coat adhesive to the damaged area, embedding color-matched granules in the base coat and application of a top coat sealant that permanently bonds the repaired layers to the original roofing material. The system and method of the invention also uses devices specifically designed and used for the present invention, such as an adjustable shingle template (isolates the damaged shingle and protects surrounding shingles from adhesives), an adjustable shingle frame device, and a compression devise to compress granules into the repaired shingle.

Figure 1A:
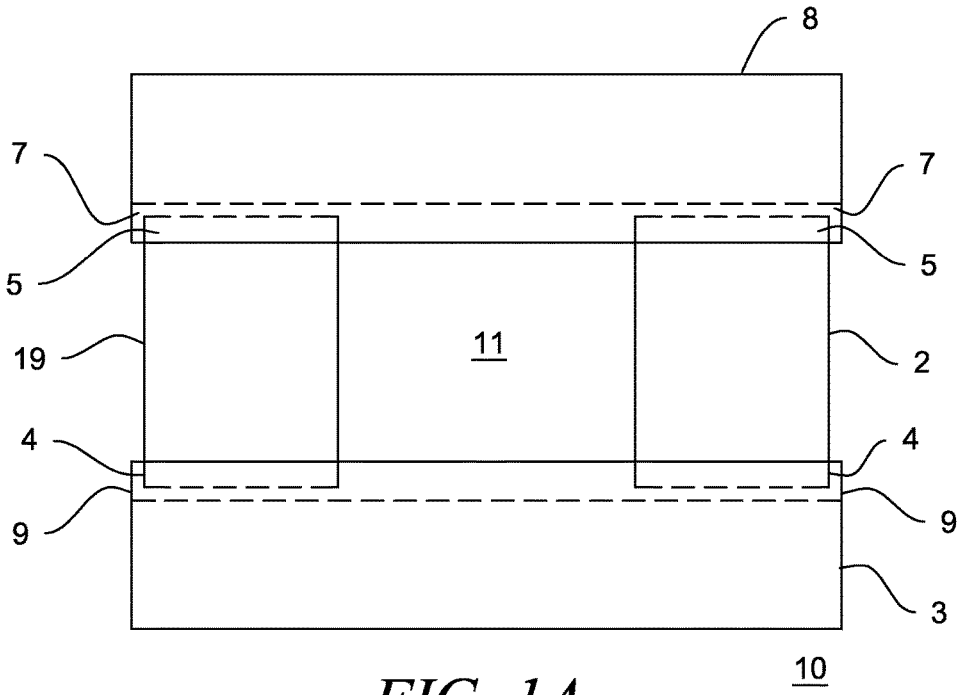
FIG. 1A is a top view of a slotted adjustable shingle template shield.
Figure 1B:
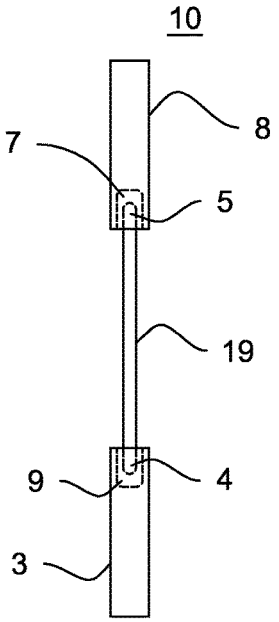
FIGS. 1B and 1C is a side view of the adjustable shingle template shield.
Figure 1C:
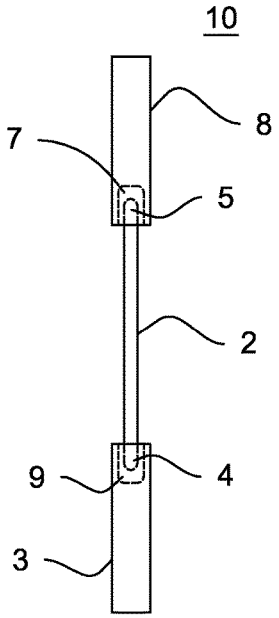

FIG. 1A is a top view of a slotted adjustable shingle template shield, and FIGS. 1B and 1C is a side view of the adjustable shingle template shield. The template shield 10 isolates the damaged shingle for adhesive application and protects surrounding undamaged shingles from adhesive application. The adjustable shingle shield 10 is situated around the perimeter of the damaged shingle to prevent the base adhesive from contacting the surrounding shingles, and the adjustable shingle shield 10 provides an adjustable opening 11 that exposes only the damaged shingle to adhesive applications while protecting the surrounding surfaces of the damaged shingles from exposure to adhesives or other application elements by having those areas covered and protected from contact.

FIG. 1A shows a slotted adjustable template shield having a left guard section 2, a right guard section 19, a top guard section 8, and a bottom guard section 3, which surrounds a damaged roof area or damaged shingle when all sections 2, 3, 19 and 8 are placed over the surrounding shingle or roofing areas. The sections 2, 3, 19, and 8 are composed of flat panels having a thickness of approximately ⅛ inch to ½ inches. The flat panels in sections 2, 3, 19 and 8 can all be made from the same materials or can be made from differing types of materials. The flat dimensions of bottom guard section 3 and top guard section 8 are between three inches to three feet in length laterally from side to side and six to sixteen inches in width from top to bottom. The dimensions of left guard section 19 and the right guard section 2 are six to sixteen inches in length laterally side to side and four inches to two feet in width from top to bottom.

At the bottom of top guard section 8 there is a slotted groove 7, and at the top of bottom guard section 3 there is a slotted groove 9. The slotted grooves 7 and 9 are of sufficient width to accommodate the thickness of left guard section 19 and right guard section 2. The top edges 5 and bottom edges 4 of the left guard section 19 and right guard section 2, respectively, reside in and slide inside the slot 7 in the top guard section 8 and slot 9 in the bottom guard section 3. By sliding the side guard sections 2 and 19 this manner, the size of the internal space 11 in the template shield 10 can be adjusted and modified to accommodate the size of the damaged area on the roof or the size of the damage shingle.

The side, top and bottom guard sections 2, 3, 8 and 19 can be composed of an elastic or flexible thermoplastic, rubber, thermoset or thermoform plastic, or similar flexible material. The side, top and bottom guard sections 2, 3, 8 and 19 can also be composed of a stiff particle board, planking, thermoplastic, rubber, thermoset or thermoform plastic, or similar stiffer material.

In FIGS. 1B and 1C, the side edge views of the adjustable template shield 10 are shown. The left edge of the adjustable template shield 10 is shown in FIG. 1B with side views of the top guard shield 8, the bottom guard shield 3 and the left guard section 19. The right edge of the adjustable template shield 10 is shown in FIG. 1C with side views of the top guard section 8, the bottom guard section 3, and the right guard section 2.

The slot 7 in the top guard section 8 and slot 9 in the bottom guard section 3 are shown in both FIGS. 1B and 1C, with each slot 7 and 9 being wide enough to accommodate the width of the left guard section 19 and right guard section 2, respectively. The width of the top 5 of both the left guard section 19 and right guard section 2 are shown residing within slot 7, while the width of the bottom 4 of the left guard section 2 and right guard section 19 are shown residing within slot 9.

Figure 2A:
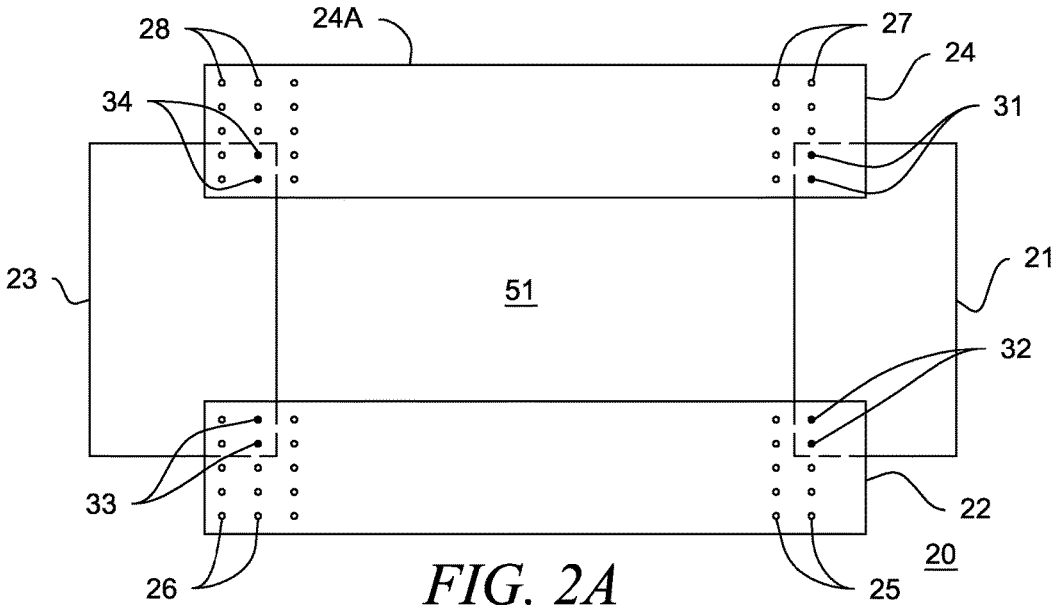
FIG. 2A is a top view of an peg-based adjustable shingle template shield.
Figure 2B:
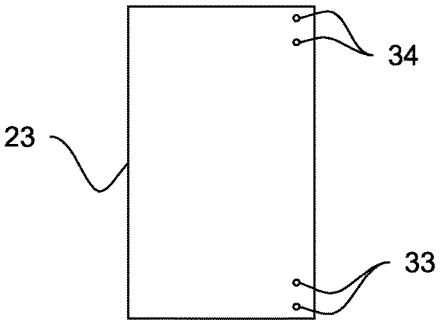
FIGS. 2B and 2C are side panels of the peg-based adjustable shingle template shield.
Figure 2C:
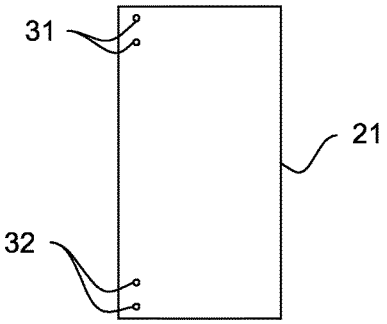
Figure 2D:
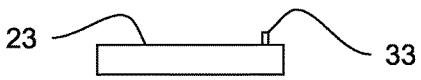
FIGS. 2D and 2E is a side view of the side panels of the peg-based adjustable shingle template shield.
Figure 2E:
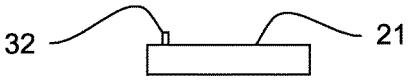
Figure 2F:
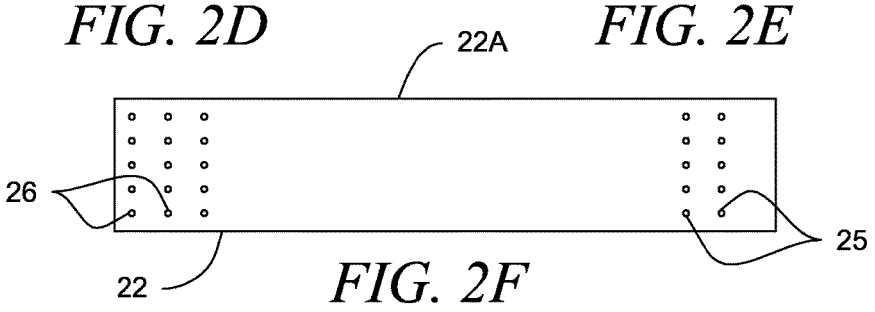
FIG. 2F is the top view of the bottom panel of the peg-based adjustable shingle template shield.

FIG. 2A is a top view of an peg-based adjustable shingle template shield, FIGS. 2B and 2C are side panels of the peg-based adjustable shingle template shield, FIGS. 2D and 2E is a side view of the side panels of the peg-based adjustable shingle template shield, and FIG. 2F is the top view of the bottom panel of the peg-based adjustable shingle template shield. As shown in FIGS. 2A to 2F, the adjustable shingle shield 51 is situated around the perimeter of the damaged shingle to prevent the base adhesive from contacting the surrounding shingles, and the adjustable shingle shield 20 provides an adjustable opening 51 that exposes only the damaged shingle to adhesive applications while protecting the surrounding surfaces of the damaged shingles from exposure to adhesives or other application elements by having those areas covered and protected from contact.

The adjustable shingle shield 20 is situated around the perimeter of the damaged shingle to prevent the base adhesive from contacting the surrounding shingles, and the adjustable shingle shield 20 provides an adjustable opening 51 that exposes only the damaged shingle to adhesive applications while protecting the surrounding surfaces of the damaged shingles from exposure to adhesives or other application elements by having those areas covered and protected from contact.

FIG. 2A shows a slotted adjustable template shield having a left guard section 23, a right guard section 21, a top guard section 24, and a bottom guard section 22, which surrounds a damaged roof area or damaged shingle when all sections 23, 21, 24, and 22 are in place. The sections 23, 21, 24, and 22 are composed of flat panels having a thickness of approximately ⅛ inch to ½ inches, and the flat panels in sections 23, 21, 24, and 22 can all be composed of the same type of materials or differing types of materials. Moreover, the side, top and bottom guard sections 23, 21, 24, and 22 can be composed of an elastic or flexible thermoplastic, rubber, thermoset or thermoform plastic, or similar flexible material. The side, top and bottom guard sections 23, 21, 24, and 22 can also be composed of a stiff particle board, planking, thermoplastic, rubber, thermoset or thermoform plastic, or similar stiffer material.

The dimensions of bottom guard section 22 and top guard section 24 are between three inches to three feet in length laterally from side to side and six to sixteen inches in width from top to bottom, with mid-sections of each panel shown in 22A and 24A, respectively. The dimension of left guard section 23 and the right guard section 21 are six to sixteen inches in length laterally side to side and four inches to two feet in width from top to bottom.

As shown in FIG. 2A, outside the mid-section area 24A on the left and right of top guard section 24 and outside the mid-section area 22A on the left and right of bottom guard section 22, there are peg apertures positioned though the thickness of top guard section 24 and bottom guard section 22, respectively. These peg apertures 27 are located on the right side of top guard section 24, peg apertures 28 are located on the left side of top guard section 24, peg apertures 25 are located on the right side of bottom guard section 22, and peg apertures 26 are located on the left side of bottom guard section 22. The peg apertures 27, 28, 26, and 25 are of sufficient diameter to receive pegs 31, 34, 33, and 32, respectively from left guard section 23 and right guard section 21. While the peg apertures 27, 28, 26, and 25 are shown in multiple parallel columns and rows, the apertures can be a single row or column depending on the desire of the user or manufacturer.

The peg apertures 27, 28, 25, and 26 have diameters that receive pegs 31, 34, 32, and 33, respectively from left guard section 23 and right guard section 21. The positioning of the left, right, top and bottom sections, 23, 21, 24 and 22 can be adjusted based on the placement of peg 31, 34, 33, and 32 through the peg apertures 27, 28, 26 and 25 in left, right, top and bottom sections, 23, 21, 24 and 22. That is, the size and shape of the opening 51 can be adjusted based on the placement and positioning of left, right, top and bottom sections, 23, 21, 24 and 22. The size of opening 51 can be minimized by using the peg apertures 31, 34, 33, and 32 on the peripheral outside border of the left, right, top and bottom sections, 23, 21, 24 and 22, whereas the size of opening 51 can be increased by using the peg apertures 31, 34, 33, and 32 located toward the inside border of the left, right, top and bottom sections, 23, 21, 24 and 22.

In FIG. 2B, the left guard section 23 is shown having pegs 34 and 33 located at the upper and lower right-hand edge of the section 23, and in FIG. 2C, the right guard section 21 is shown having pegs 31 and 32 located at the upper and lower left-hand edge of the section 21. The lower edge of the left guard section 23 is shown in FIG. 2D with the pegs 33 located on the right edge of the left guard section 23, and the lower edge of the right guard section 21 is shown in FIG. 2E with the pegs 32 located on the left edge of the right guard section 23.

As shown in FIG. 2F, outside the mid-section area 22A on the left and right of top guard section 22, there are peg apertures positioned though the thickness of bottom guard section 22, respectively. These peg apertures 25 are located on the right side of bottom guard section 22 and peg apertures 26 are located on the left side of bottom guard section 22. The peg apertures 26 and 25 are of sufficient diameter to receive pegs 32 and 33, respectively from left guard section 23 and right guard section 21 shown in FIGS. 2A-2E. While the peg apertures 26 and 25 are shown in multiple parallel columns and rows, the apertures can be a single row or column depending on the desire of the user or manufacturer.

The peg apertures 25 and 26 shown in FIG. 22 have diameters that receive pegs 32 and 33, respectively from left guard section 23 and right guard section 21. The positioning of the left, right, top and bottom sections 23, 21, 24 and 22 can be adjusted based on the placement of peg 31, 34, 33, and 32 through the peg apertures 27, 28, 26 and 25 in left, right, top and bottom sections, 23, 21, 24 and 22. That is, the size and shape of the opening 51 can be adjusted based on the placement and positioning of left, right, top and bottom sections, 23, 21, 24 and 22. The size of opening 51 can be minimized by using the peg apertures 31, 34, 33, and 32 on the peripheral outside border of the left, right, top and bottom sections, 23, 21, 24 and 22, whereas the size of opening 51 can be increased by using the peg apertures 31, 34, 33, and 32 located toward the inside border of the left, right, top and bottom sections, 23, 21, 24 and 22.

Figure 3A:
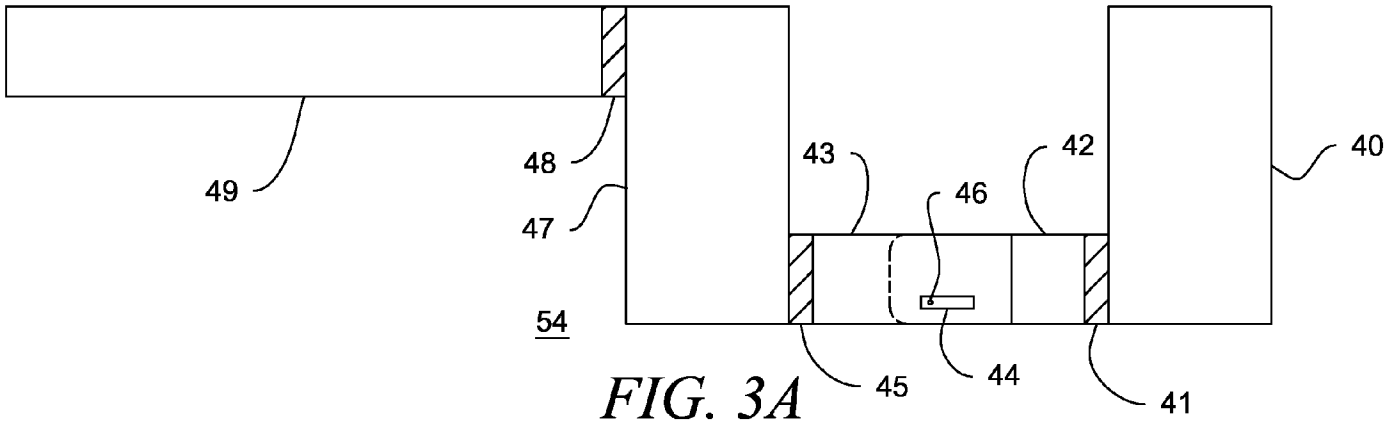
FIG. 3A is a top view of a hinge-based adjustable shingle template shield in the open position.
Figure 3C:
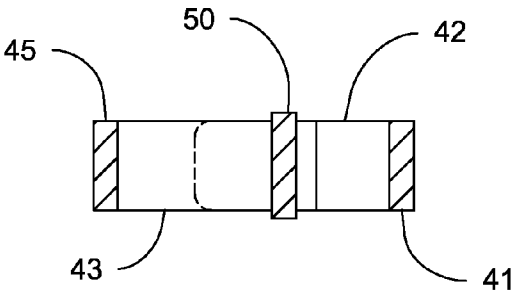
FIG. 3C is an alternative adjustable slide for use in the hinge-based adjustable shingle template shield.
Figure 3B:
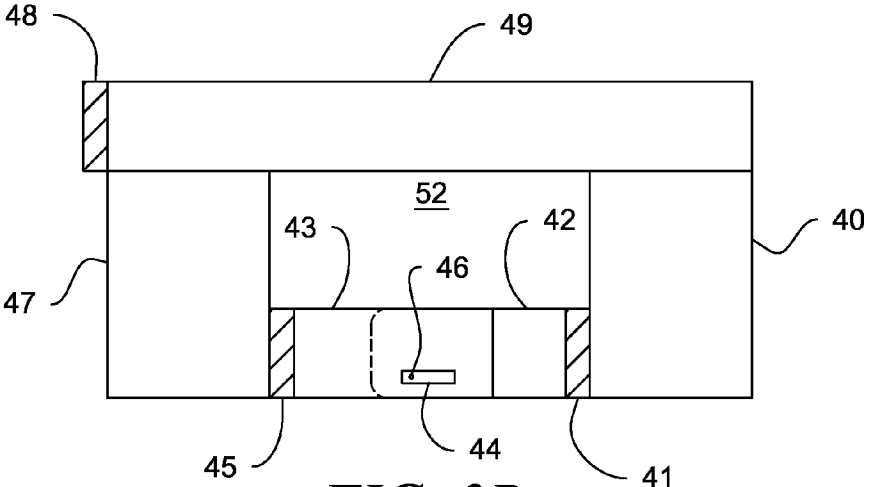
FIG. 3B is a top view of a hinge-based adjustable shingle template shield in the closed position.

FIG. 3A is a top view of a hinge-based adjustable shingle template shield in the open position, FIG. 3B is a top view of a hinge-based adjustable shingle template shield in the closed position, and FIG. 3C is an alternative adjustable slide for use in the hinge-based adjustable shingle template shield. As shown in FIGS. 3A to 3C, the adjustable shingle shield 54 is situated around the perimeter of the damaged shingle to prevent the base adhesive from contacting the surrounding shingles, and the adjustable shingle shield 54 provides an adjustable opening 52 that exposes only the damaged shingle to adhesive applications while protecting the surrounding surfaces of the damaged shingles from exposure to adhesives or other application elements by having those areas covered and protected from contact.

As shown in FIG. 3A, there are side, bottom right, bottom left, left, and top guard sections 40, 42, 43, 47, and 49, with the top guard panel 49 being positioned in the open position above opening 52. There is a hinge assembly 41 located between right side panel 40 and bottom right panel 42, and there is a hinge assembly 45 located between bottom left panel 43 and left panel 47. There is also a second hinge assembly located on left panel 47 between left panel 47 and top panel 49. The hinge assemblies 41, 45 and 48 allow the panels to be folded for transport and assembly, which permits easy use at the point of repair. As shown in FIG. 3A, the right panel 40, bottom right panel 42, bottom left panel 43, and left panel 47 are shown laying out in a planar position, with the top guard panel 49 being positioned off to the left of the left panel 47.

The side, bottom right, bottom left, left, and top guard sections 40, 42, 43, 47, and 49 are composed of flat panels having a thickness of approximately ⅛ inch to ½ inches, and the flat panels in sections 40, 42, 43, 47, and 49 can all be composed of the same type of materials or differing types of materials. Moreover, the side, top and bottom guard sections 40, 42, 43, 47, and 49 can be composed of an elastic or flexible thermoplastic, rubber, thermoset or thermoform plastic, or similar flexible material. The side, bottom right, bottom left, left, and top guard sections 40, 42, 43, 47, and 49 can also be composed of a stiff particle board, planking, thermoplastic, rubber, thermoset or thermoform plastic, or similar stiffer material.

The dimensions of bottom left and bottom right guard sections 43 and 42, as well as the top guard section 49 are between three inches to three feet in length laterally from side to side and six to sixteen inches in width from top to bottom. The dimension of left guard section 47 and the right guard section 40 are six to sixteen inches in length laterally side to side and four inches to two feet in width from top to bottom.

The size and shape of the opening 52 can be adjusted based on the placement and positioning of bottom left and bottom right sections 43 and 42. The size of opening 52 can be minimized laterally by moving bottom left and bottom right sections 43 and 42 closer together using the slotted groove 44 and groove guide post 46. The size of opening 52 can be increased laterally by moving bottom left and bottom right sections 43 and 42 further apart using the slotted groove 44 and groove guide post 46.

In FIG. 3B, the side, bottom right, bottom left, left, and top guard sections 40, 42, 43, 47, and 49, with the top guard panel 49 are shown being positioned in the closed position above opening 52. There is a hinge assembly 41 located between right side panel 40 and bottom right panel 42, and there is a hinge assembly 45 located between bottom left panel 43 and left panel 47. There is also a second hinge assembly located on left panel 47 between left panel 47 and top panel 49. The hinge assemblies 41, 45 and 48 allow the panels to be folded for transport and assembly, which permits easy use at the point of repair. As shown in FIG. 3B, the right panel 40, bottom right panel 42, bottom left panel 43, and left panel 47 are shown laying out in a planar position, with the top guard panel 49 being positioned on top of and over to the right of the left panel 47.

Alternatively, as shown in FIG. 3C, the size and shape of the opening 52 can be adjusted based on the placement and positioning of bottom left and bottom right sections 43 and 42 surrounded by hinge assemblies 45 and 41, respectively. The size of opening 52 can be minimized laterally by moving bottom left and bottom right sections 43 and 42 closer together using the bracket 50 to retain the proximity between bottom left and bottom right sections 43 and 42 as they are slid over each other. The size of opening 52 can be increased laterally by moving bottom left and bottom right sections 43 and 42 further apart using the together using the bracket 50 to retain the proximity between bottom left and bottom right sections 43 and 42 as they are slid over each other.

Figure 4:
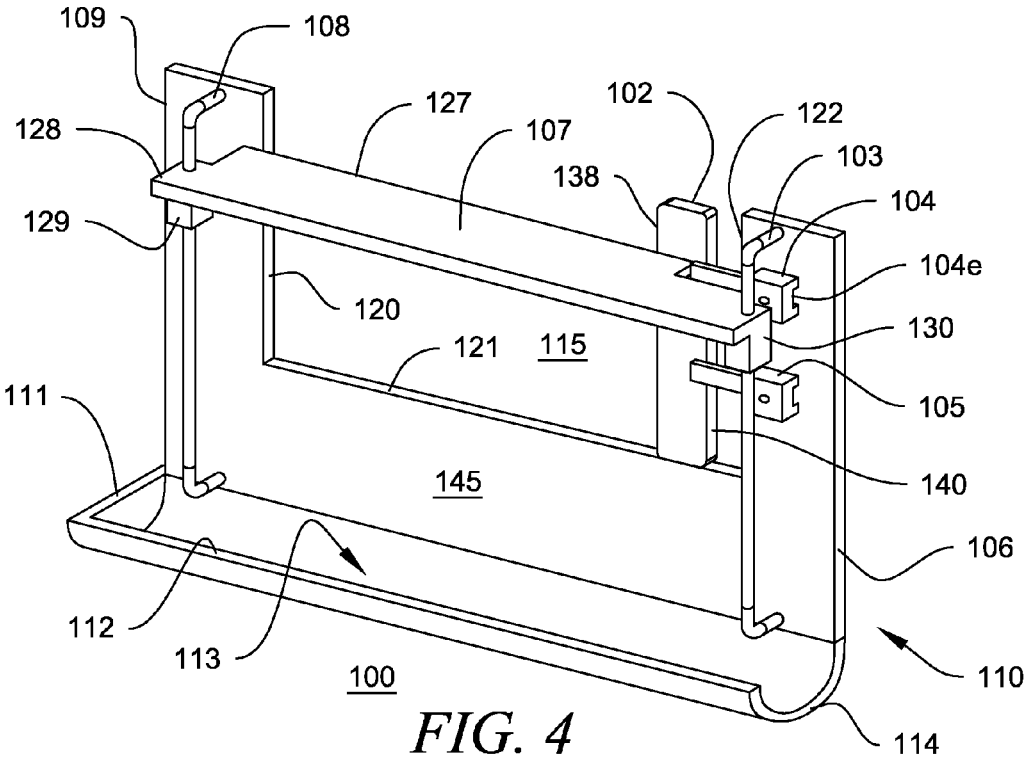
FIG. 4 is perspective view an adjustable shingle frame.
Figure 4A:
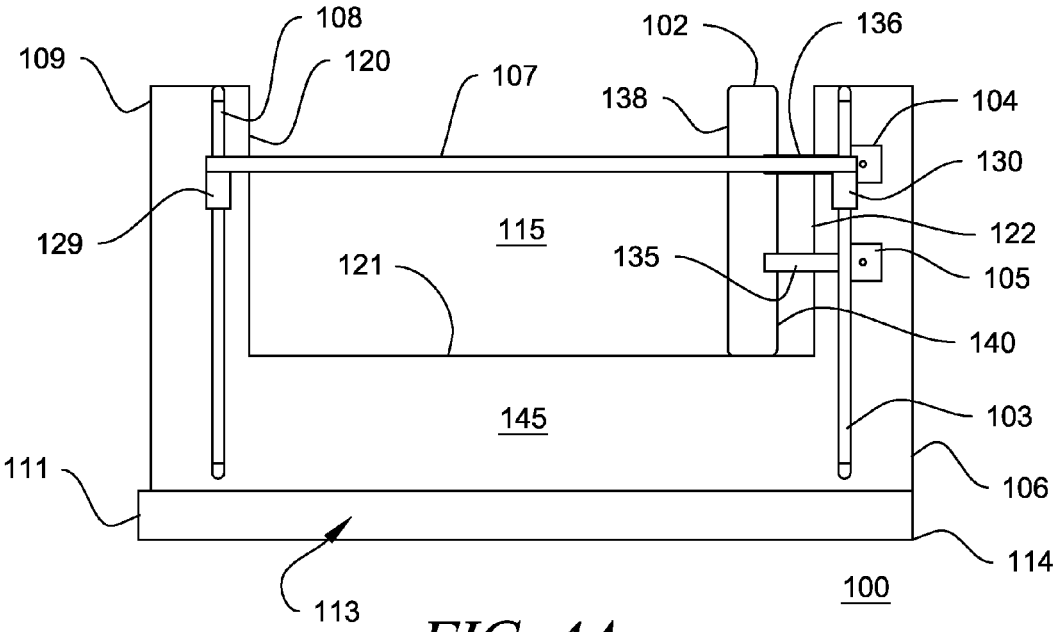
FIG. 4A is a top view of the adjustable shingle frame.

FIG. 4 is perspective view an adjustable shingle frame, and FIG. 4A is a top view of the adjustable shingle frame, FIG. 4B is the side view of the base plate in the adjustable shingle frame, and FIG. 4C is a top side view of the base plate in the adjustable shingle frame. In FIG. 4, an adjustable shingle frame 100 is shown for repair and processing of the shingle area to be repaired. In FIG. 4, the adjustable shingle frame 100 has a body frame body 110 having a main section 145, a right body extension 106, and a left body extension 109. The main section 145 and the left and right body extensions 106 and 109, respectively, define an internal space 115 surrounded by central bottom edge 121, a left edge 120 and a right edge 122.

The internal space 115 defines an area where the damaged area of the roof or damaged roofing shingle is located, and where the repair processing steps are performed on the shingle being repaired. The shingle frame 100 shown in FIG. 4 is situated around the perimeter of the shingle that has been coated with the base adhesive. The U-shaped shingle perimeter opening 115 is situated such that the adhesive coated shingle surface is exposed within the U-shaped opening with the granule catch pan 113 situated at the bottom of the shingle shield 110 and the adjustable granule leveling slide 107 is situated at the top of the shingle shield 110.

The adjustable granule leveling slide 107 is positioned in the highest vertical position along the slide support bars 103 and 108. The horizontal adjustment blade 102 is positioned with the adjustment blade arms 136 and 135 held securely by the horizontal adjustment blade locks 104 and 105, each having a slide lock area 104*e*. When the frame is properly situated around the perimeter of the shingle, the entire surface of the shingle to be repaired is exposed vertically between the bottom edge of the U-shaped opening 121 of base plate 106 and the adjustable granule leveling slide 107, and horizontally between the left edge 120 and the right edge 121 of the shield body 106.

As shown in FIG. 4, the shingle frame 100 has an adjustment blade 102 and a leveling slide bar 107. The adjustment blade 102 has a left edge 138 and a right edge 140, along with an upper lateral extension 136 and a lower lateral extension 135. The adjustment blade 102 positions shingle frame 100 in the correct placement for processing the repair. The adjustment blade 102 can be moved laterally left to right (or vice-versa) by virtue of the placement of upper extension 136 and the lower extension 135 through the slots 104*e* placed in the blade slotted block locks 104 and 105. The slotted blocks 104 and 105 are position on left extension 106 of the shingle frame body 110.

As shown in FIG. 4, the leveling slide bar 107 has a leveling edge 127, a grasping edge 128, a left slide bar guide 129 and a right slide bar guide 130. The left slide bar guide 129 has an aperture 129*a* where slide rod 108 is positioned to allow the leveling slide bar 107 to be slid up and down thereupon. The right slide bar guide 130 has an aperture 130*a* where slide rod 103 is position to allow the leveling slide bar 107 to be slid up and down thereupon. The left slide rod 108 is affixed to the right extension 109 and right slide rod 103 is affixed to the left extension 109, respectively.

The shingle shield 100 has an overflow catch 113 that has a spout 114, an outer edge 112, and a closed catch end 111. Granules are custom prepared by mixing appropriate sized particles with the desired colored coating in a rotating cement-type mixer until granules are fully coated and dry. Custom prepared granules are applied to the damaged area in the same manner as those prepared in advance. Granules are distributed evenly over the base adhesive to replicate the granule density on the surrounding shingles. Slightly more granular material than desired in the final repair may be added to indentions at this point in the process since excess granular material that has not adhered to base adhesive will be removed prior to sealing the repair. Granular material is also lightly dispersed over the entire surface of the shingle to blend the repaired indention with the surrounding shingle.

Granular material should be added to the base adhesive within 30 minutes of application of the base adhesive to the damaged shingle. Granules may be applied to the base adhesive by hand broadcasting, by a shaker apparatus or other means to evenly distribute the granules across the surface of the shingle. After distribution of the granules over the adhesive-coated shingle surface, the granule leveling slide 107 is moved downwardly along the slide support bars 103 and 108 of the shingle frame 100 with excess granules being swept downwardly and collected in granule catch pan 113. Granule leveling slide 107 may be actuated 2-3 additional times in order to achieve a level distribution of granules over the shingle surface. Granule leveling slide 107 is then left in the down position below the bottom of U-shaped shingle opening 115 and above granule catch pan 113.

In FIG. 4A, the adjustable shingle frame 100 has a body frame body 110 having a main section 145, a right body extension 106, and a left body extension 109. The main section 145 and the left and right body extensions 106 and 109, respectively, define an internal space 115 surrounded by central bottom edge 121, a left edge 120 and a right edge 122. The internal space 115 defines an area where the damaged area of the roof or damaged roofing shingle is located, and where the repair processing steps are performed on the shingle being repaired.

The shingle frame 100 shown in FIG. 4A is situated around the perimeter of the shingle that has been coated with the base adhesive. The U-shaped shingle perimeter opening 115 is situated such that the adhesive coated shingle surface is exposed within the U-shaped opening with the granule catch pan 113 situated at the bottom of the shingle shield 110 and the adjustable granule leveling slide 107 is situated at the top of the shingle shield 110.

The adjustable granule leveling slide 107 is positioned in the highest vertical position along the slide support bars 103 and 108. The horizontal adjustment blade 102 is positioned with the adjustment blade arms 136 and 135 held securely by the horizontal adjustment blade locks 104 and 105, each having a slide lock area 104*e*. When the frame is properly situated around the perimeter of the shingle, the entire surface of the shingle to be repaired is exposed vertically between the bottom edge of the U-shaped opening 121 of base plate 106 and the adjustable granule leveling slide 107, and horizontally between the left edge 120 and the right edge 121 of the shield body 106. The shingle shield 100 has an overflow catch 113 that has a spout 114, an outer edge 112, and a closed catch end 111.

As shown in FIG. 4A, the shingle frame 100 has an adjustment blade 102 and a leveling slide bar 107. The adjustment blade 102 has a left edge 138 and a right edge 140, along with an upper lateral extension 136 and a lower lateral extension 135. The adjustment blade 102 positions shingle frame 100 in the correct placement for processing the repair. The adjustment blade 102 can be moved laterally left to right (or vice-versa) by virtue of the placement of upper extension 136 and the lower extension 135 through the slots 104*e* placed in the blade slotted block locks 104 and 105. The slotted blocks 104 and 105 are position on left extension 106 of the shingle frame body 110.

In FIG. 4B, the side view of shingle shield 100 is shown with the right extension 106, an overflow catch 113 that has a spout 114, an outer edge 112, and a closed catch end 111. In FIG. 4C, the adjustable shingle frame 100 has a body frame body 110 having a main section 145, a right body extension 106, and a left body extension 109. The main section 145 and the left and right body extensions 106 and 109, respectively, define an internal space 115 surrounded by central bottom edge 121, a left edge 120 and a right edge 122.

The shingle frame 100 shown in FIGS. 4B and 4C is situated around the perimeter of the shingle that has been coated with the base adhesive. The U-shaped shingle perimeter opening 115 is situated such that the adhesive coated shingle surface is exposed within the U-shaped opening with the granule catch pan 113 situated at the bottom of the shingle shield 110 and the adjustable granule leveling slide 107 is situated at the top of the shingle shield 110. When the frame is properly situated around the perimeter of the shingle, the entire surface of the shingle to be repaired is exposed vertically between the bottom edge of the U-shaped opening 121 of base plate 106 and the adjustable granule leveling slide 107, and horizontally between the left edge 120 and the right edge 121 of the shield body 106. The shingle shield 100 has an overflow catch 113 that has a spout 114, an outer edge 112, and a closed catch end 111.

FIG. 5A is the perspective view of the slide bar of the adjustable shingle frame, FIG. 5B is side view of the slide bar in the adjustable shingle frame, and FIG. 5C is front view of the slide bar in the adjustable shingle frame. In FIG. 5A, the right slide rod 103 is shown such that the leveling slide bar 107 is slid up and down thereupon. As shown in FIG. 5A, the slide rod 103 are affixed to the right extension 106, and slide rod 103 has a right end 103*a*, and right elbow joint 103*e*, a main length shaft 103*b*, a left elbow joint 103*d*, and a left end 103*c*.

In FIG. 5B, the right end 103*a* and right elbow joint 103*e* are shown, and in FIG. 5C, the right end 103*a*, and right elbow joint 103*e*, a main length shaft 103*b*, a left elbow joint 103*d*, and a left end 103*c* are shown. When in use, the adjustable granule leveling slide 107 is positioned is slid along the slide support bars 103 shown in FIG. 5A to 5C. After distribution of the granules over the adhesive-coated shingle surface, the granule leveling slide 107 is moved downwardly along the slide support bar 103 shown in FIGS. 5A to 5C of the shingle frame 100 with excess granules being swept downwardly and collected in granule catch pan 113. Granule leveling slide 107 may be actuated 2-3 additional times in order to achieve a level distribution of granules over the shingle surface.

Figure 6A:
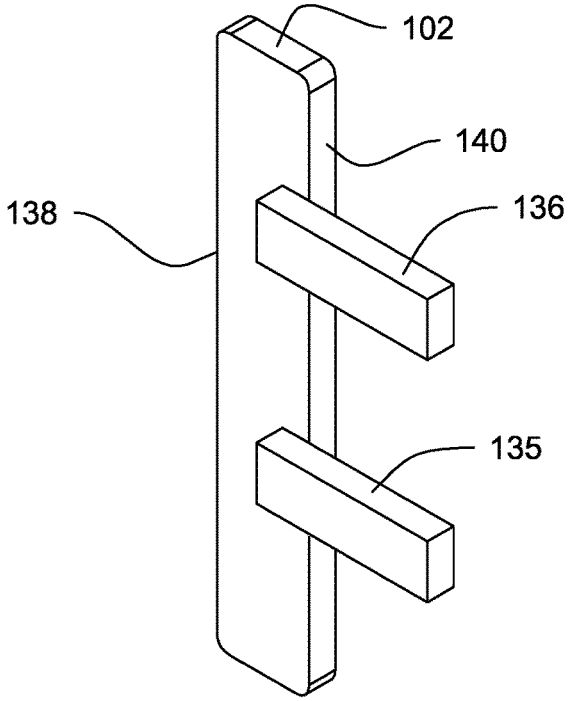
FIG. 6A is the perspective view of the adjustment blade of the adjustable shingle frame.
Figure 6C:
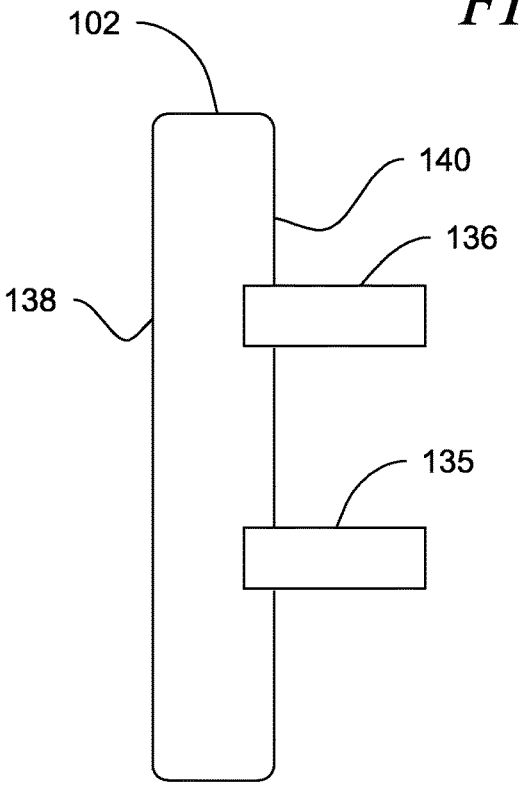
FIG. 6C is a top view of the adjustment blade in the adjustable shingle frame.
Figure 6B:
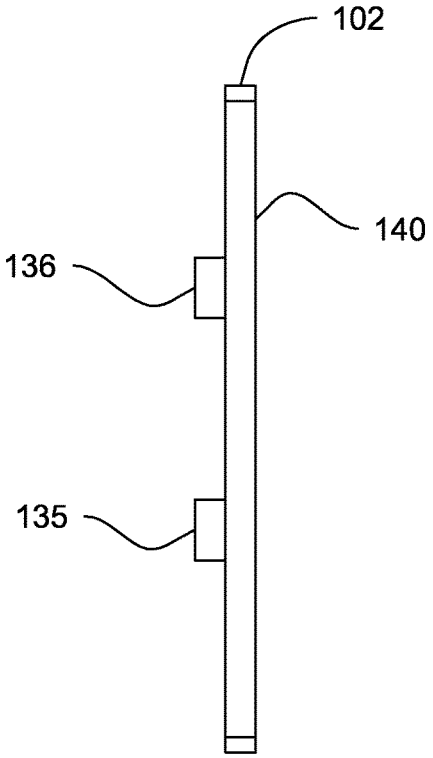
FIG. 6B is a side view of the adjustment blade of the adjustable shingle frame.

FIG. 6A is the perspective view of the adjustment blade of the adjustable shingle frame, FIG. 6B is a side view of the adjustment blade of the adjustable shingle frame, and FIG. 6C is a top view of the adjustment blade in the adjustable shingle frame. In FIG. 6A, the shingle frame 100 has an adjustment blade 102 that has a left edge 138 and a right edge 140, along with an upper lateral extension 136 and a lower lateral extension 135. The adjustment blade 102 positions shingle frame 100 in the correct placement for processing the repair. The adjustment blade 102 can be moved laterally left to right (or vice-versa) by virtue of the placement of upper extension 136 and the lower extension 135 through the slots 104*e* placed in the blade slotted block 104 and 105. The slotted blocks 104 and 105 are position on left extension 106 of the shingle frame body 110.

FIG. 6B shows the right edge view of the adjustment blade 102 with an edge view of right edge 140, upper lateral extension 136 and a lower lateral extension 135. FIG. 6B shows the top view of the adjustment blade 102 with a top view of the left edge 138, right edge 140, upper lateral extension 136 and a lower lateral extension 135. When in use, the horizontal adjustment blade 102 shown in FIGS. 6A to 6C is positioned with the adjustment blade arms 136 and 135 held securely by the horizontal adjustment blade locks 104 and 105, each having a slide lock area 104*e*. When the frame is properly situated around the perimeter of the shingle, the entire surface of the shingle to be repaired is exposed vertically between the bottom edge of the U-shaped opening 121 of base plate 106 and the adjustable granule leveling slide 107, and horizontally between the left edge 120 and the right edge 121 of the shield body 106.

Figure 7B:
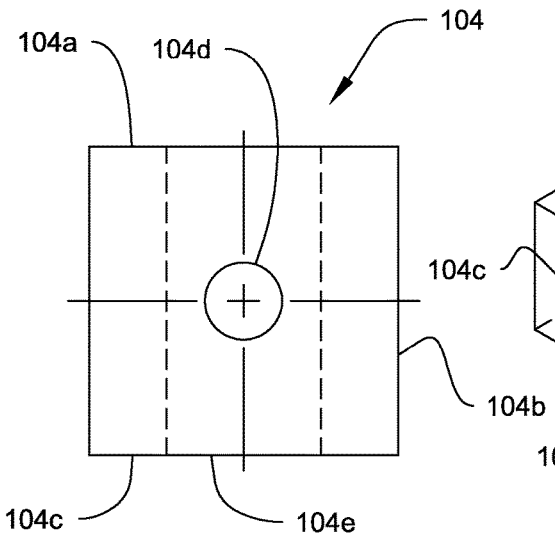
FIG. 7B is a top view of the blade lock in the adjustment shingle frame.
Figure 7A:
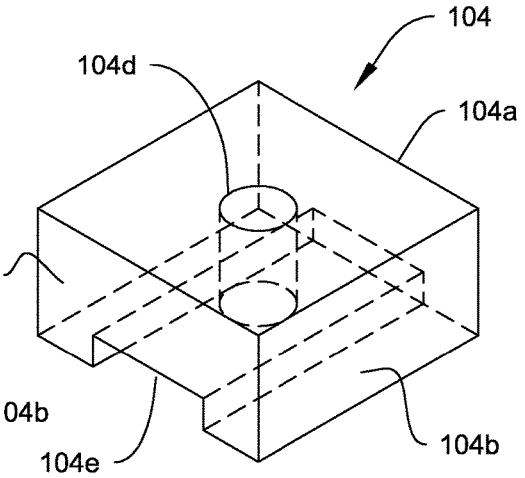
FIG. 7A is the perspective view of the blade lock in the adjustment shingle frame.
Figure 7D:
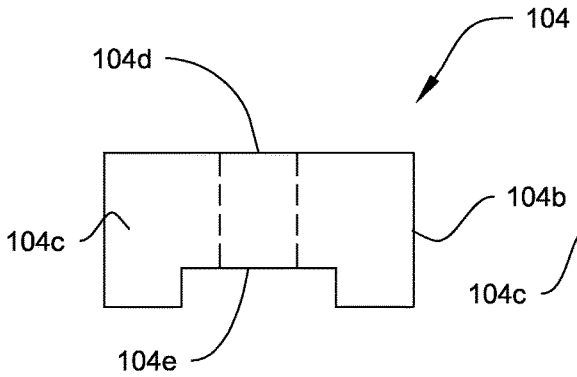
FIG. 7C is a front view of the blade lock in the adjustment shingle frame, and, FIG. 7D is a side view of the blade lock in the adjustment shingle frame.
Figure 7C:
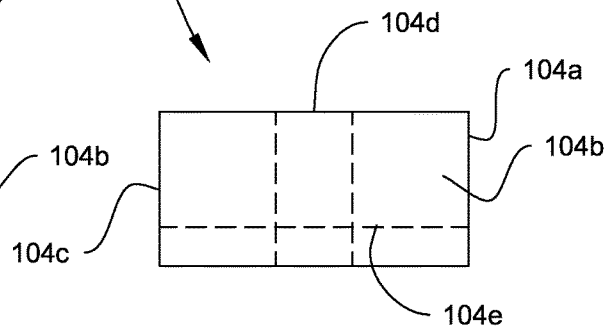

FIG. 7A is the perspective view of the blade lock in the adjustment shingle frame, FIG. 7B is a top view of the blade lock in the adjustment shingle frame, FIG. 7C is a front view of the blade lock in the adjustment shingle frame, and, FIG. 7D is a side view of the blade lock in the adjustment shingle frame. FIG. 7A is slotted block 104 shown in perspective view having back side 104*a*, front side 104*b*, left side 104*c*, slotted groove 104*e* and block aperture 104*d*. FIG. 7B shows the top view of block 104 having back side 104*a*, front side 104*b*, left side 104*c*, slotted groove 104*e* and block aperture 104*d*. FIG. 7C is the front view of locking block 104 showing back side 104*a*, front side 104*b*, left side 104*c*, slotted groove 104*e* and block aperture 104*d*, and FIG. 7D is the left side view of locking block 104 showing front side 104*b*, left side 104*c*, slotted groove 104*e* and block aperture 104*d*.

The adjustment blade 102 has an upper lateral extension 136 and a lower lateral extension 135 that positions shingle frame 100 in the correct placement for processing the repair, and the adjustment blade 102 can be moved laterally left to right (or vice-versa) by virtue of the placement of upper extension 136 and the lower extension 135 through the slots 104*e* placed in the blade slotted block 104 shown in FIGS. 7A to 7D. The slotted blocks 104 and 105 are position on left extension 106 of the shingle frame body 110.

Figure 8A:
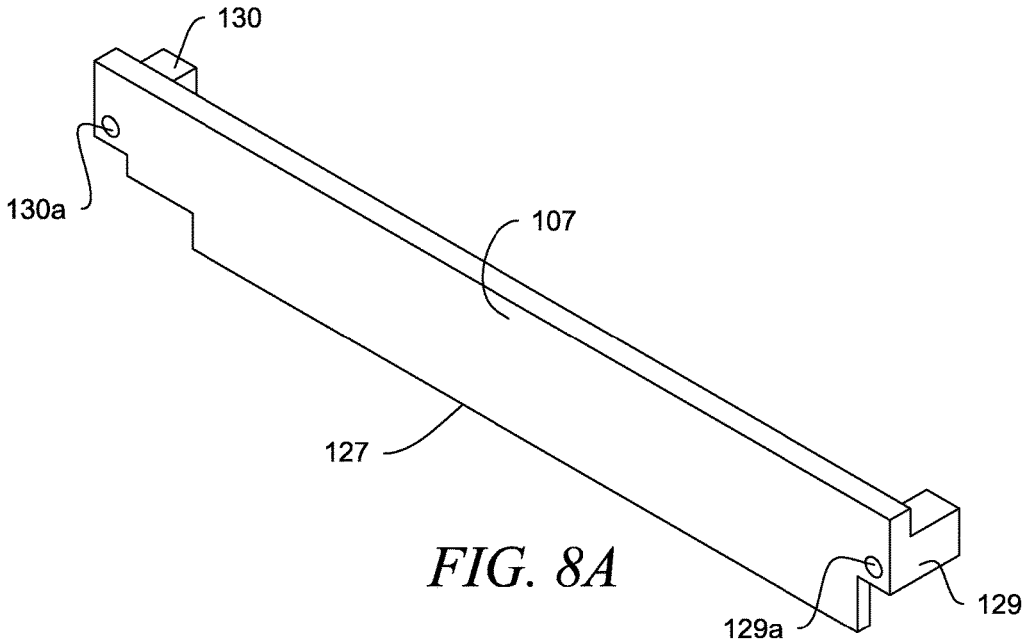
FIG. 8A is the perspective view of a leveling slide of the adjustment shingle frame.
Figure 8B:
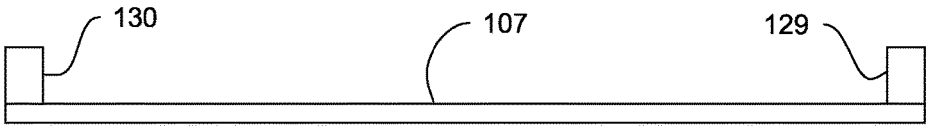
FIG. 8B is the top view of a leveling slide of the adjustment shingle frame.
Figure 8C:
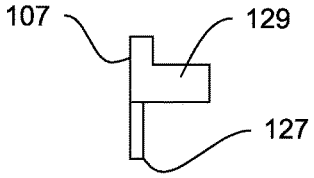
FIG. 8C is the side view of a leveling slide of the adjustment shingle frame.
Figure 8D:
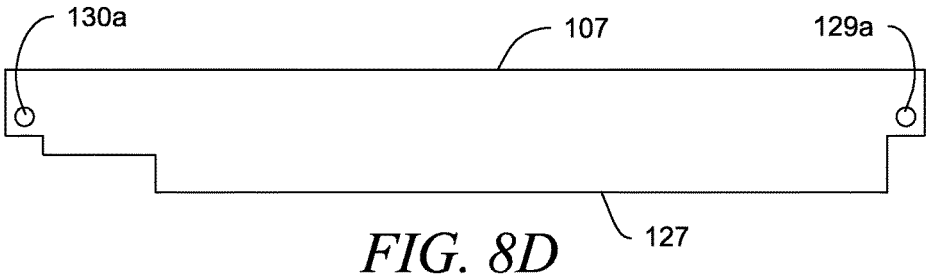
FIG. 8D is the bottom view of a leveling slide of the adjustment shingle frame, and, FIG. 9A is a rectangular compression plate for use with the adjustment shingle frame.

FIG. 8A is the perspective view of a leveling slide of the adjustment shingle frame, FIG. 8B is the top view of a leveling slide of the adjustment shingle frame, FIG. 8C is the side view of a leveling slide of the adjustment shingle frame, and FIG. 8D is the bottom view of a leveling slide of the adjustment shingle frame. In FIG. 8A, the leveling slide bar 107 has a leveling edge 127, a left slide bar guide 129 and a right slide bar guide 130. The left slide bar guide 129 has an aperture 129*a* where slide rod 108 is positioned to allow the leveling slide bar 107 to be slid up and down thereupon. The right slide bar guide 130 has an aperture 130*a* where slide rod 103 is position to allow the leveling slide bar 107 to be slid up and down thereupon. The slide rod 108 is affixed to the left extension 109 and right extension 106, respectively.

In FIG. 8B, the leveling slide bar 107 is shown in a top view with a left slide bar guide 129 and a right slide bar guide 130. In FIG. 8C, the leveling slide bar 107 is shown in a side view with a leveling edge 127 and a left slide bar guide 129 where the left slide bar guide 129 has an aperture 129*a* to position slide rod 108 so as to allow the leveling slide bar 107 to be slid up and down thereupon. In FIG. 8D, the front view of leveling slide bar 107 is shown with leveling edge 127, a right slide bar aperture 130*a* and a left slide bar aperture 129*a*, these apertures allowing the slide rod 103 and 108 to be positioned so as to allow the leveling slide bar 107 to be slid up and down thereupon.

When the frame is properly situated around the perimeter of the shingle, the entire surface of the shingle to be repaired is exposed vertically between the bottom edge of the U-shaped opening 121 of base plate 106 and the adjustable granule leveling slide 107, and horizontally between the left edge 120 and the right edge 121 of the shield body 106. Granular material should be added to the base adhesive within 30 minutes of application of the base adhesive to the damaged shingle. Granules may be applied to the base adhesive by hand broadcasting, by a shaker apparatus or other means to evenly distribute the granules across the surface of the shingle.

Granules are distributed evenly over the base adhesive to replicate the granule density on the surrounding shingles. Granular material is also lightly dispersed over the entire surface of the shingle to blend the repaired indention with the surrounding shingle. The adjustable granule leveling slide 107 is positioned in the highest vertical position along the slide support bars 103 and 108.

Slightly more granular material than desired in the final repair may be added to indentions at this point in the process since excess granular material that has not adhered to base adhesive will be removed prior to sealing the repair. Granule leveling slide 107 may be actuated 2-3 additional times in order to achieve a level distribution of granules over the shingle surface. Granule leveling slide 107 is then left in the down position below the bottom of U-shaped shingle opening 115 and above granule catch pan 113. The shingle shield 100 has an overflow catch 113 that has a spout 114, an outer edge 112, and a closed catch end 111.

Figure 9A:
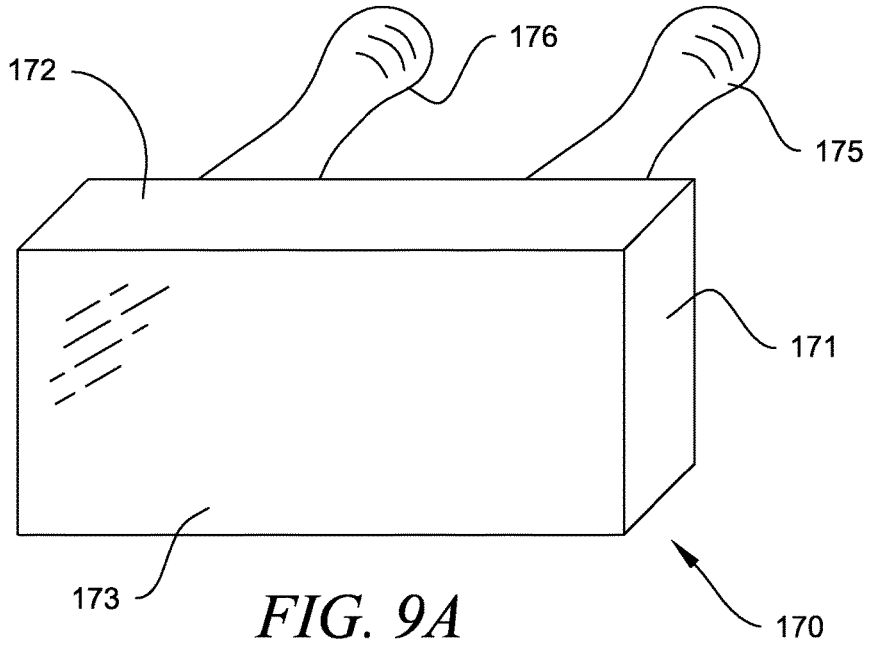
FIG. 9B is a square compression plate for use with the adjustment shingle frame, and, FIG. 9C is a circular compression plate for use with the adjustment shingle frame.
Figure 9B:
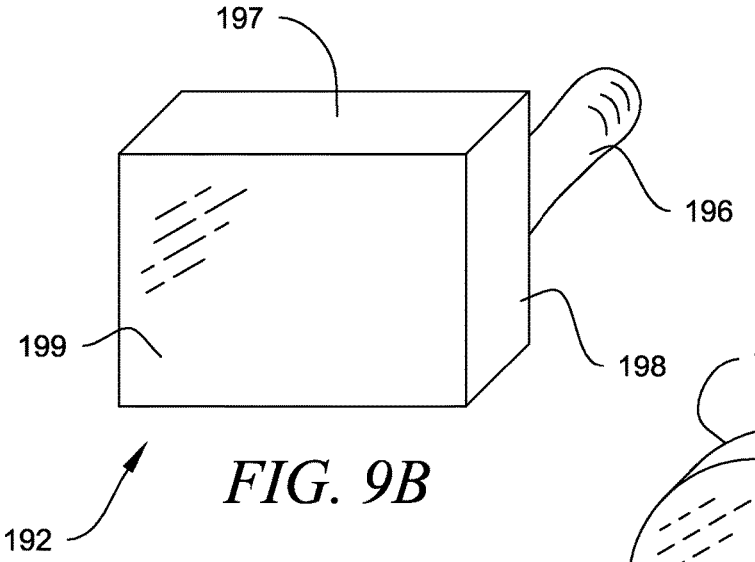
Figure 9C:
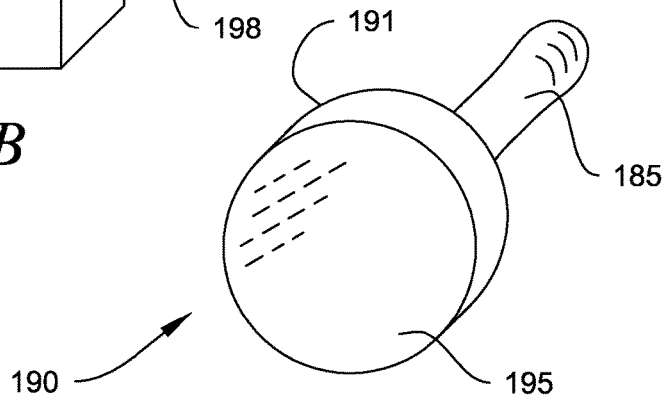

FIG. 9A is a rectangular compression plate for use with the adjustment shingle frame, FIG. 9B is a square compression plate for use with the adjustment shingle frame, and, FIG. 9C is a circular compression plate for use with the adjustment shingle frame. Granules are then compressed into the base adhesive by means of the compression plates 170, 190 and 192 in FIGS. 9A, 9B and 9C. As shown in FIG. 9A, a rectangular compression plate 170 is shown having a face plate 173, left side 171, top side 172, and handles 175 and 175. FIG. 9B shows a square compression plate 192 with a face plate 199, left side 198, top side 197, and handle 196. FIG. 9C shows a circular compression plate 190 with a face plate 195, side 191, and handle 185.

As used, the compression plates at FIGS. 9A to 9C show the devices that allow a user to compress granules by firmly pressing the granules using the face plates 173, 199 and 195 into the base adhesive such that the adhesive comes part of the way up the sides of the granules to ensure granules are secured to base the adhesive. Compression plates 170, 190 and 199 fit within the U-shaped shingle opening 115 of the shingle frame 100 shown in FIGS. 4 and 4A. When the compression plate 170, 192 and 190 is held by the compression plate handles 175, 176, 196 and 185, a firm downward pressure can be applied by hand to the granules distributed across the surface of the shingle to be repaired with the granules being evenly compressed into the base adhesive assuring good adhesion of the granules to the adhesive and the underlying shingle.

The compression plate can span the entire width of U-shaped opening 115 using a rectangular compression plate, such as shown in FIG. 9A, or may be narrower by ¼ to ½ the width of the opening to allow for shingle exposures that are less than the width of opening 115 with the use of compression plates 192 and 190 in FIGS. 9B and 9C. If compression plate 192 and 190 is narrower than opening 115, operator can compress a portion of the granules then the compression plate will be lifted and moved across the repair area in overlapping sequences to embed granules across the entirety of the shingle. Optionally, a hand trowel or other flat apparatus can be used to compress granules.

The method of invention repairs the damaged shingle and replaces dislodged granules through the steps of: (1) removing debris from the damaged area of the shingle, (2) situating the shingle shield around the shingle perimeter, (3) filling the indention and coating shingle surface with a base adhesive, (4) removing the shingle shield, (5) situating the shingle frame around the shingle perimeter, (6) applying color-matched granules to the base adhesive, (7) leveling the granules with the granule leveling slide of the shingle frame, (8) compressing the granules into the base adhesive with the shingle frame compression plate, (9) removing shingle frame from shingle, (10) removing loose granules from repair site, (11) re-situating shingle shield around shingle perimeter, and (12) applying a topcoat sealant that permanently bonds the repair to the original shingle. The repaired shingle will be restored to full functionality with greater impact resistance than the original shingle and be an aesthetic match to the surrounding roofing materials.

In Step 1, the damaged area is cleared of debris and loose granules. The damaged shingle area is first cleared of debris which may interfere with the bonding process. Clearing may be by means of brushing or blowing debris from the area. It is not necessary to remove all loose granules, but it is preferable to remove accumulated organic debris such as leaves or dirt.

In Step 2, the Shingle Shield 100 shown in FIGS. 1A-1C, 2A-2F, and 3A-3C is positions around damaged roof or damaged shingle perimeter. The shingle shield device 10 is situated around the perimeter of the damaged shingle to prevent the base adhesive from contacting the surrounding shingles. The adjustable shingle shield 10 is situated around the perimeter of the damaged shingle to prevent the base adhesive from contacting the surrounding shingles, and the adjustable shingle shield 10 provides an adjustable opening 11 that exposes only the damaged shingle to adhesive applications while protecting the surrounding surfaces of the damaged shingles from exposure to adhesives or other application elements by having those areas covered and protected from contact.

In step 3, a base adhesive is applied to damaged shingle positioned in the opening 11, 51 and 52 of Shingle Shield 100 shown in FIGS. 1A-1C, 2A-2F, and 3A-3C. Prior to application of the base adhesive, the shingle has been isolated in a shingle frame shield which protects the surrounding shingles from the adhesive. Once the shingle shield is secured around the shingle perimeter, the base adhesive is applied to the damaged area. Application of the base adhesive by brush is preferred for small, shallow or isolated areas. A roller, such as a short nap J-roller or adhesives-type roller, is preferred for larger areas of damage or those areas with deeper indentions. A sprayer or J-roller may be used for large areas involving multiple indentions. A notched spreader may be used for moderate sized areas having deep indentions.

The base adhesive may be applied by brushing, rolling, spraying, notched spreader, or other means to distribute an even coat of adhesive to the shingle. Indentions are filled with adhesive to the level of the base shingle followed by a thin even distribution of the base adhesive across the entire surface of the shingle. The base adhesive coat should preferably be applied approximately 1/16" to 1/8" thick to provide an adequate base to adhere the granules to the shingle. The type of base adhesive used will determine the preferred means of application. For example, epoxies are best applied by brush or roller.

Preferred base adhesives are contact cement type adhesives, neoprene-modified asphalt based adhesives, and epoxy based adhesives. The base adhesive must be compatible with the underlying asphalt surface of the shingle. An accelerant may be added to the base adhesive to speed up the cure time between steps.

One preferred type of base adhesive is contact cement. Contact cement is an adhesive, which, when coated on surfaces and allowed to dry, provides an instant permanent bond when surfaces are brought into firm contact. Contact cements are composed of a solids portion that is the bonding agent of the adhesive, and carrier portion of either aqueous or chemical solvents which act as carriers of the bonding agent during application to a surface.

The solid portions of the adhesives may contain natural rubber, neoprene (synthetic rubber) or other bonding agents. Neoprene-based contact adhesives in non-aqueous solvents are preferred for use in the method of the invention. Preferred non-aqueous solvents for a neoprene-based adhesive are toluene, methyl ethyl ketone, naphtha, heptanes and combination thereof. Specific adhesives components can be selected to meet the needs of a particular application.

Contact cement is applied to the damaged area of the shingle and allowed to dry for 1-30 minutes during which the solvent evaporates. After the drying time, the adhesive will have formed a flexible bond to the underlying shingle with no residual moisture and the granules will adhere on contact to the adhesive. Contact adhesives should be allowed to cure for around 30 to 90 minutes before application of the topcoat.

Another preferred type of base adhesive is neoprene-modified asphalt adhesive, also known as polymer modified (rubberized) bitumen. Unmodified asphalt is sensitive to extremes in temperature, becoming brittle in cold conditions and softening at higher temperatures. Modification of asphalt by addition of an elastomeric polymer results in a more elastic and durable adhesive with greater temperature stability. Elastomers are high molecular weight polymers produced by the polymerization of chlorophene. Neoprene is an elastomer (a synthetic type rubber), which resist oils and aging, has a high resistance to water, and is flexible over a wide temperature range.

The neoprene-modified asphalt bonding agent is generally supplied in a solvent, such as a mineral spirits or other petroleum-based solvent, which must be compatible with the asphalt base material in the shingles. Not all neoprene containing adhesives are operational in the method of the invention. Some neoprene-containing adhesives will react with the asphalt in the shingles causing holes to form further weakening the shingle, so an adhesive that is compatible with the shingle base must be used for the method of the invention.

Neoprene-modified asphalt adhesives may contain additional components, such as reinforcing fibers or modifiers such as accelerants, which may improve the use for certain applications. Reinforcing fibers and accelerants may be useful in adhesives for shingle repair to speed drying time. Neoprene-modified asphalt adhesive is applied to the damaged area and allowed to dry for 1-30 minutes during which any solvent evaporates. After the drying time, the adhesive will have formed a flexible bond to the underlying shingle with no residual moisture and the granules will adhere to the adhesive. Neoprene-modified asphalt adhesives should be allowed to cure for around 30 to 90 minutes before application of the topcoat.

Another preferred type of base adhesive is an epoxy adhesive. Epoxy adhesives have high bond strength with good heat and chemical resistance, negligible shrinkage, and the ability to bond to non-porous surfaces. Epoxies are a class of reactive polymer and co-polymers characterized by the presence of the epoxide group, most commonly in epichlorohydrin, which crosslink to themselves or to various classes of co-reactants or hardeners to achieve the desired end characteristics. Epoxies generally are supplied with two components, which when mixed chemically react to form a strong bond.

Epoxide resins suitable for epoxy adhesives include bisphenol-A epoxy resins, bisphenol-F epoxy resins, phenolic novalac epoxy resins, aliphatic epoxy resins and glycidylamine epoxy resins. Bisphenol-A epoxy resins are most preferred for the use in the method of the invention. Co-reactants useful for epoxy adhesives include amines, such as aliphatic primary amines, aromatic primary amines, amine adducts, and tertiary amines, amides, thiols (mercaptans), acids, anhydrides, and combinations thereof. Selection of co-reactants will affect cure rates and final properties of the adhesive, as well as exothermic properties associated with the curing. Heat released from highly exothermic curing reactions can lead to damage of the shingle base, and exothermic properties must be considered when selecting a co-reactant. Amine co-reactants are preferred for the method of the invention. Epoxy adhesives should be allowed to cure for around 30 to 120 minutes before application of the topcoat. Heat or accelerants can be used to speed up the drying time.

The choice of base adhesive is made based on the following considerations: the underlying material of the shingle, the color of the underlying shingle, the size of the damaged shingle area, the pitch of the damaged roof area, the ambient air/roof surface temperature at the time of the repair, and the general climate of the geographic location. The underlying material of the damaged shingle is generally paper or fiberglass that has been saturated with asphalt. Base adhesives must be compatible with asphalt. Some types of adhesives will chemically react with the asphalt causing holes or blistering in the shingle. Some adhesives will generate heat through the exothermic curing process that can cause damage to the asphalt base layer.

The base color of the shingle will generally be gray to black because of the asphalt saturated into the shingle base, and gray to black adhesives can be used. Areas with deep indentions may have color variations due to displacement of the base asphalt and an asphalt based adhesive is preferable for this type of repair to even out the coloration. Clear adhesives may be used where the damage is primarily dislodgement of the granules and the underlying asphalt has not been displaced.

The size of the damaged area will range from a few centimeters within a shingle encompassing the area of a hail strike up to widespread damage over the majority of the shingle surface. Depth of the damage is assessed in addition to surface area damage. Clear fast-curing base adhesives are preferred when the damaged areas are small and the primary repair is replacing granules in small area. Asphalt based adhesives are preferred to repair larger or deeper areas of damage.

The pitch of the roof will determine the preferred base adhesive for shingle repair. A steep pitch would require the use of a faster curing base adhesive to prevent drift of the adhesive within the repair and to allow the granules to adhere in the damaged area with a minimum of movement. A flatter roof section would need a self-leveling adhesive to prevent surface irregularities.

Temperatures should be above freezing (32° F./0° C.) for application of the base coat. Surface temperature of roof should not exceed 150° F. (65.6° C.) for best results. Base adhesives will vary in ideal operational temperature ranges and the adhesive may be selected based on the ambient air/roof surface temperature at the time of the repair.

The general climate of geographic location of the structure being repaired is also considered when selecting a base adhesive. More northern climates require the use of adhesive with good resistance to extended periods of below-freezing temperatures. More southern climates require the use of adhesives with good resistance to extended periods of temperatures in excess of 100° F.

In step 4, the shingle shield is removed from the shingle to be repaired after the base adhesive is applied to shingle surface taking care not to disturb the base adhesive.

In Step 5, the shingle frame 100 shown in FIGS. 4 to 4A is positioned around the shingle to be repaired. The main section 145 and the left and right body extensions 106 and 109, respectively, define an internal space 115 surrounded by central bottom edge 121, a left edge 120 and a right edge 122. The internal space 115 defines an area where the damaged area of the roof or damaged roofing shingle is located, and where the repair processing steps are performed on the shingle being repaired.

As shown in FIGS. 4 and 4A, the shingle frame 100 has an adjustment blade 102 and a leveling slide bar 107. The adjustment blade 102 has a left edge 138 and a right edge 140, along with an upper lateral extension 136 and a lower lateral extension 135. The adjustment blade 102 positions shingle frame 100 in the correct placement for processing the repair. The adjustment blade 102 can be moved laterally left to right (or vice-versa) by virtue of the placement of upper extension 136 and the lower extension 135 through the slots 104*e* placed in the blade slotted block locks 104 and 105. The slotted blocks 104 and 105 are position on left extension 106 of the shingle frame body 110.

The shingle frame 100 shown in FIGS. 4 and 4A is situated around the perimeter of the shingle that has been coated with the base adhesive. The U-shaped shingle perimeter opening 115 is situated such that the adhesive coated shingle surface is exposed within the U-shaped opening with the granule catch pan 113 situated at the bottom of the shingle and the adjustable granule leveling slide 107 situated at the top of the shingle. The adjustable granule leveling slide 107 is positioned in the highest vertical position along the slide support bars 103 and 108.

The horizontal adjustment blade 102 is positioned with the adjustment blade arms 135 and 136 held securely by the horizontal adjustment blade locks 104 and 105 When the frame is properly situated around the perimeter of the shingle, the entire surface of the shingle is exposed vertically between the bottom edge of the U-shaped opening 115 of base plate 100 and the adjustable granule leveling slide 127, and horizontally between the edge of the horizontal adjustment blade 102 and the inside of the U-shaped opening 115 on the opposing side of the shingle frame base 110.

In step 6, granular material is applied on top of the base adhesive. Granules for roofing materials are mineral-based particles (for example, granite) with a ceramic coating. Granules are prepared by crushing stone into small particles and separating the particles by size based on the particular application. Sized particles are coated in ceramic to give color to the granules, along with any other desired properties such as reflectivity and algaecidal properties.

Granules may be prepared in advance to meet commonly used size and color specifications. An appropriate color match may then be selected from the prepared granules for application to the damaged area. Granules may be color-matched by comparing the granules on the existing shingles to prepared sample boards displaying known granule color combinations or by comparing to loose granule samples if custom blending of granule colors is required.

Granules may also be custom prepared by mixing appropriate sized particles with the desired colored coating in a rotating cement-type mixer until granules are fully coated and dry. Custom prepared granules are applied to the damaged area in the same manner as those prepared in advance. Granules are distributed evenly over the base adhesive to replicate the granule density on the surrounding shingles. Slightly more granular material than desired in the final repair may be added to indentions at this point in the process since excess granular material that has not adhered to base adhesive will be removed prior to sealing the repair. Granular material is also lightly dispersed over the entire surface of the shingle to blend the repaired indention with the surrounding shingle.

Granular material should be added to the base adhesive within 30 minutes of application of the base adhesive to the damaged shingle. Granules may be applied to the base adhesive by hand broadcasting, by a shaker apparatus or other means to evenly distribute the granules across the surface of the shingle.

In Step 7, the applied granules are leveled over the shingle surface using the leveling slide 107 on the shingle frame 100 shown in FIGS. 4 and 4A. The adjustable granule leveling slide 107 is positioned in the highest vertical position along the slide support bars 103 and 108. As shown in FIG. 4, the leveling slide bar 107 has a leveling edge 127, a grasping edge 128, a left slide bar guide 129 and a right slide bar guide 130. The left slide bar guide 129 has an aperture 129*a* where slide rod 108 is positioned to allow the leveling slide bar 107 to be slid up and down thereupon.

The right slide bar guide 130 has an aperture 130*a* where slide rod 103 is position to allow the leveling slide bar 107 to be slid up and down thereupon. The left slide rod 108 is affixed to the right extension 109 and right slide rod 103 is affixed to the left extension 109, respectively.

Granules are custom prepared by mixing appropriate sized particles with the desired colored coating in a rotating cement-type mixer until granules are fully coated and dry. Custom prepared granules are applied to the damaged area in the same manner as those prepared in advance. Granules are distributed evenly over the base adhesive to replicate the granule density on the surrounding shingles. Slightly more granular material than desired in the final repair may be added to indentions at this point in the process since excess granular material that has not adhered to base adhesive will be removed prior to sealing the repair. Granular material is also lightly dispersed over the entire surface of the shingle to blend the repaired indention with the surrounding shingle.

Granular material should be added to the base adhesive within 30 minutes of application of the base adhesive to the damaged shingle. Granules may be applied to the base adhesive by hand broadcasting, by a shaker apparatus or other means to evenly distribute the granules across the surface of the shingle. After distribution of the granules over the adhesive-coated shingle surface, the granule leveling slide 107 is moved downwardly along the slide support bars 103 and 108 of the shingle frame 100 with excess granules being swept downwardly and collected in granule catch pan 113. Granule leveling slide 107 may be actuated 2-3 additional times in order to achieve a level distribution of granules over the shingle surface. Granule leveling slide 107 is then left in the down position below the bottom of U-shaped shingle opening 115 and above granule catch pan 113.

In Step 8, excess granules are removed off the repaired shingle using the overflow catch 113 on the shingle shield 100 shown in FIGS. 4 and 4A. The shingle shield 100 shown in FIGS. 4 and 4A has an overflow catch 113 that has a spout 114, an outer edge 112, and a closed catch end 111. After distribution of the granules over the adhesive-coated shingle surface, the granule leveling slide 107 is moved down the slide support bars 103 and 108 of the shingle frame 100 and excess granules are collected in granule catch pan 113. Granule leveling slide 127 may be actuated 2-3 additional times in order to achieve a level distribution of granules and removal of granules over the shingle surface. Granule leveling slide 127 is then left in the down position below the bottom of U-shaped shingle opening 115 and above granule catch pan 113. Steps 7 and 8 may be performed separately or contemporaneously with each other.

In Step 9, the applied and leveled granules are compressed into base adhesive. Granules are then compressed into the base adhesive by means of the compression plates 170, 190 and 192 in FIGS. 9A, 9B and 9C. As shown in FIG. 9A, a rectangular compression plate 170 is shown having a face plate 173, left side 171, top side 172, and handles 175 and 175. FIG. 9B shows a square compression plate 192 with a face plate 199, left side 198, top side 197, and handle 196. FIG. 9C shows a circular compression plate 190 with a face plate 195, side 191, and handle 185.

As used, the compression plates at FIGS. 9A to 9C show the devices that allow a user to compress granules by firmly pressing the granules using the face plates 173, 199 and 195 into the base adhesive such that the adhesive comes part of the way up the sides of the granules to ensure granules are secured to base the adhesive. Compression plates 170, 190 and 199 fit within the U-shaped shingle opening 115 of the shingle frame 100 shown in FIGS. 4 and 4A. When the compression plate 170, 192 and 190 is held by the compression plate handles 175, 176, 196 and 185, a firm downward pressure can be applied by hand to the granules distributed across the surface of the shingle to be repaired with the granules being evenly compressed into the base adhesive assuring good adhesion of the granules to the adhesive and the underlying shingle.

The compression plate can span the entire width of U-shaped opening 115 using a rectangular compression plate, such as shown in FIG. 9A, or may be narrower by ¼ to ½ the width of the opening to allow for shingle exposures that are less than the width of opening 115 with the use of compression plates 192 and 190 in FIGS. 9B and 9C. If compression plate 192 and 190 is narrower than opening 115, operator can compress a portion of the granules then the compression plate will be lifted and moved across the repair area in overlapping sequences to embed granules across the entirety of the shingle. Optionally, a hand trowel or other flat apparatus can be used to compress granules.

In step 10, the shingle frame 100 is removed. After the granules have been compressed into the base adhesive, the shingle frame is carefully removed to prevent dislodging the newly applied granules. The base adhesive is allowed to dry for approximately 30-90 minutes before proceeding to the next step. A heat gun may be used to speed the drying time.

In step 11, any remaining loose granules are removed from the repaired shingle. After the base adhesive is dry, excess granules are removed by blower or by brush. The final granule density should replicate the granule density on the surrounding shingles.

In step 12, the Shingle Shield 100 shown in FIGS. 1A-1C, 2A-2F, and 3A-3C is re-positioned around damaged roof or damaged shingle perimeter. The shingle shield device 10 is situated around the perimeter of the damaged shingle to prevent the base adhesive from contacting the surrounding shingles. The adjustable shingle shield 10 is situated around the perimeter of the damaged shingle to prevent the base adhesive from contacting the surrounding shingles, and the adjustable shingle shield 10 provides an adjustable opening 11 that exposes only the damaged shingle to adhesive applications while protecting the surrounding surfaces of the damaged shingles from exposure to adhesives or other application elements by having those areas covered and protected from contact.

In Step 13, a topcoat sealer is applied to the repaired portion of the roof or repaired roofing shingle. After granules have been compressed into the base adhesive, the base adhesive has sufficiently dried, and the excess granules have been removed from the repair area, a topcoat sealant is applied over the granules. The topcoat sealant will permanently bond the granules and the base adhesive to the underlying shingle.

The topcoat sealant is applied by spraying a light mist of the sealant over the granules. The Shingle Shield 100 shown in FIGS. 1A-1C, 2A-2F, and 3A-3C is used to protect the surrounding shingles from overspray of the topcoat sealant. Care should be taken not to over-apply the sealant since this will cause a noticeable difference from the surrounding shingles. Additional applications of the topcoat sealant may be made, or the sprayed shingle may be blotted with a piece of absorbent material to remove excess sealant, until a desired final finish that matches the surrounding shingles is achieved.

The topcoat sealant is preferably an organic or inorganic acrylic polymer or copolymer that is compatible with the base adhesive, and will dry to form a clear coat over the shingle. The topcoat sealant will permanently bond the granules and the base adhesive to the underlying shingle and will create a barrier over the repair that provides the repaired shingle with increased impact resistance, increased weather resistance, and improved UV resistance.

The topcoat sealant can be sprayed, brushed or rolled over the repaired shingle. The preferred method of topcoat application is spraying. The topcoat sealant needs to cure for approximately 2-4 hours prior to foot traffic in the area. Once the topcoat sealant has sufficiently cured, the repaired shingles will be visually indistinguishable from the surrounding shingles. After the topcoat sealant is applied to the shingle surface the shingle frame is removed.

The process for full coat resurfacing of a roof is similar in methodology to repairing a section of roofing, and varies primarily in the magnitude of the application of materials. When applied to the entire existing roof, the application of base adhesive, color-matched granules, granule compression and topcoat sealant will achieve a Class 4 Impact Resistance Rating for entire treated surface along with increased weather and UV resistance.

Example 1

Roof pitch as adhesive selection criterion. Roof pitch describes the angle of the roof as compared to the structure underneath. The primary reason for pitching a roof to redirect water or snow off the roof. Roof pitch is usually expressed as a rational fraction, such as 5/12, with each number representing the coordinates of an angle, or as a ratio 5:12. The angle is based on a roofs rise (height) and run (width). A pitch number of 5/12 means for every 12 feet, the roof rises 5 feet, and corresponds to a pitch angle of about 22.62 degrees, and a pitch of 12/12 corresponds to a pitch angle of 45 degrees.

The higher the pitch (angle) of the roof, the faster drying the base adhesive should be. A roof pitch greater than 6/12 may be considered a high pitch roof and will benefit from using a faster drying adhesive, such as a fast set epoxy, in the method of the invention. A faster drying adhesive will allow better adhesion of the granules with less likelihood of downward drift of the granules.

Example 2

Climate as adhesive selection criterion. The general climate of the geographical location of the roof should be considered when selecting the base adhesive for the method of the invention. Within the United States, there are areas that experience prolonged periods of extreme cold with sub-zero temperatures persisting for weeks, and there are also areas that experience prolonged periods of extreme heat with daytime high temperatures exceeding 100° F. for extended periods of time.

Contact type cements have a service range down to −40° F. making these types of adhesives suitable adhesive for roofing repairs in areas likely to experience extremely cold winters.

Neoprene-modified asphalt adhesives have an application temperature range up to 120° F. making these types of adhesives suitable for roofing repairs in areas needing repairs during hot summer months.

Example 3

Size of damaged area as adhesive selection criterion. If the damage to an individual shingle involves a number of hail strikes, large areas of de-granulation or deep indentions with accompanying granule loss, a dark colored base adhesive will aid in restoring the shingle to aesthetically match the surrounding shingles. Neoprene-modified asphalt adhesives will more readily color blend with the asphalt of the shingle for repairing such larger areas of damage.

Example 4

Economic Benefit of Repair Method. In 2013, a roofing repair following the method of the invention was made to the damaged roof of a commercial property in Oklahoma. The replacement estimate for the roof was $122,000. The repair method of the invention was used to fully restore the roof for a cost of $48,800 representing a cost savings of 60%.

While the invention has been described, disclosed, illustrated and shown in various terms of certain embodiments or modifications which it has presumed in practice, the scope of the invention is not intended to be, nor should it be deemed to be, limited thereby, and such other modifications or embodiments as may be suggested by the teachings herein are particularly reserved, especially as they fall within the breadth and scope of the claims here appended.

We claim:

1. A system for repairing an area on one or more shingles on a roof comprising:

a debris remover that removes debris around said area on one or more roofing shingles;

an adhesive base coat applicator that applies an adhesive base coat to said area on one or more shingles, said adhesive base coat being selected from a group consisting of contact adhesive, epoxy-based adhesive, or neoprene-modified asphalt based adhesives, a granule distributor that distributes replacement granules over the adhesive base coat on the area of one or more shingles, wherein said replacement granules are selected from a group consisting of color-matched granite, colored granite particles, uncolored granite particles, ceramic-based particles, or ceramic-coated particles;

a granule leveling slide adjustably mounted on an adjustable shingle frame to level out said replacement granules;

a compression plate having a wide surface area, said compression plate compresses said replacement granules into the adhesive base coat substantially aligned with granules surrounding the area on one or more shingles; and, a top coat sealant applicator that applies a top coat sealant to said area on one or more shingles, said top coat sealant sealing the area on one or more shingles and said top coat sealant formulation being selected from a group consisting of an organic acrylic polymer, an inorganic acrylic polymer, or a co-polymer that bonds all applied materials to the one or more damaged shingle.

2. The system according to claim 1 further comprising:

a shingle shield that is positioned around the perimeter of said area on one or more shingles after said debris particles are removed around said area on one or more shingles, said shingle shield isolates said area on one or more shingles from surrounding shingles.

3. The system according to claim 2 wherein said shingle shield is removable after said adhesive base coat is applied to the area on one or more shingles.

4. The system according to claim 2 wherein said shingle shield is adjustable by mechanical adjustments.

5. The system according to claim 1 wherein said shingle frame is positioned around the perimeter of the area on one or more shingles after the adhesive base coat is applied to said area.

6. The system according to claim 1 further comprising: parallel slide rails that extend over a top surface of the shingle frame, said granule leveling slide is positioned on said parallel slide rails on the shingle frame, said granule leveling slide leveling out said granules across the surface of said area on one or more shingles.

7. The system according to claim 6 wherein said granule leveling slide has a slide adjustment blade and blade locks.

8. A system for repairing an area on one or more shingles on a roof comprising:

an adhesive base coat applicator that applies an adhesive base coat to said area on one or more shingles, said adhesive base coat being selected from a group consisting of contact adhesive, epoxy-based adhesive, or neoprene-modified asphalt based adhesives, a granule distributor that distributes replacement granules over the adhesive base coat on the area of one or more shingles, wherein said replacement granules are selected from a group consisting of color-matched granite, colored granite particles, uncolored granite particles, ceramic-based particles, or ceramic-coated particles;

a granule leveling slide adjustably mounted on an adjustable shingle frame to level out said replacement granules;

a compression plate having a weighted surface area, said compression plate compresses said replacement granules into the adhesive base coat so that said replacement granules are substantially aligned with granules that surround the area on one or more shingles; and, a top coat sealant applicator that applies a top coat sealant to said area on one or more shingles, said top coat sealant seals the area on one or more shingles and said top coat sealant formulation being selected from a group consisting of an organic acrylic polymer, an inorganic acrylic polymer, or a co-polymer that bonds all applied materials to the one or more damaged shingle.

9. The system according to claim 8 further comprising:

a shingle shield that is positioned around the perimeter of said area on said one or more shingles to isolate said area on said one or more shingles for the application of said adhesive base coat.

10. The system according to claim 9 wherein said shingle shield is adjustable to cover variable areas on said roof.

11. The system according to claim 10 wherein said shingle shield is adjusted by a pin and slot combination assembly.

12. The system according to claim 8 further comprising:

said shingle frame is positioned around the perimeter of the area on one or more shingles after the adhesive base coat is applied, said shingle frame having parallel slide rails that extend over a top surface of the shingle frame.

13. The system according to claim 12 further comprising: said granule leveling slide is positioned on said parallel slide rails on the shingle frame, said granule leveling slide leveling out said replacement granules across the surface of said area on one or more damaged shingle.

14. The system according to claim 13 wherein said granule leveling slide has a slide adjustment blade.

15. A method for repairing an area on one or more shingles on a roof comprising the steps of:

(a) removing any debris particles that may be present on and around the area on one or more shingles;

(b) applying an adhesive base coat to the area on one or more shingles, said adhesive base coat selected from a group of adhesives including contact adhesive, epoxy-based adhesive, or neoprene-modified asphalt based adhesive;

(c) distributing replacement granules over the adhesive base coat on the area on one or more shingles, wherein said replacement granules are selected from a granule group including color-matched granite, colored granite rock, uncolored granite rock, ceramic based particles, or ceramic coated particles;

(d) leveling out said replacement granules using a granule leveling slide adjustably mounted to an adjustable shingle frame;

(e) positioning a compression plate having a weighted surface area over the replacement granules on the area on one or more shingles;

(f) compressing said replacement granules into the adhesive base coat with said compression plate such that the replacement granules are substantially embedded into the adhesive base coat and substantially level with any granules surrounding the area on the one or more shingles;

(g) allowing said adhesive base coat to dry after the replacement granules are embedded using the compression plate;

(h) removing excess replacement granules from the area on the one or more shingles; and, (i) applying a top coat sealant formulation to seal the area on the one or more shingles, said top coat sealant formulation being selected from a group consisting of an organic acrylic polymer, an inorganic acrylic polymer, or a co-polymer that bonds all the applied materials to the one or more damaged shingles.

16. The method of claim 15 further comprising the steps of:

(a) positioning a shingle shield around the perimeter of the area on one or more shingles to isolate the area on one or more shingles on the roof prior to applying the adhesive base coat; and, (b) removing the shingle shield from the perimeter of the area on one or more shingles after the adhesive base coat is applied.

17. The method of claim 16 wherein said shingle shield is adjustable.

18. The method of claim 17 wherein said shingle shield is adjusted by a pin and slot combination assembly.

19. The method of claim 15 further comprising the steps of:

(a) positioning said shingle frame around the perimeter of the area on one or more shingles having the adhesive base coat, and (b) removing the shingle frame from said area on one or more shingles after compression of the granules.

20. The method of claim 15 further comprising the steps of: (a) positioning said granule leveling slide on one or more slide rails on the shingle frame; (b) actuating said granule leveling slide along said one or more slide rails on the shingle frame to level one or more of the granules across the surface of the area on one or more shingles.

21. The method of claim 20 wherein said leveling slide having an adjustment blade and blade locks.

22. A method for repairing an area on one or more shingles on a roof comprising the steps:

preparing the area on one or more shingles;

applying an adhesive base coat to the area on said one or more shingles, said adhesive base coat being selected from a group consisting of contact adhesive, epoxy-based adhesive, or neoprene-modified asphalt based adhesives;

distributing replacement granules over the adhesive base coat on the area on said one or more shingles, wherein said replacement granules are selected from a group consisting of color-matched granite, colored granite rock, uncolored granite rock, ceramic-based particles, or ceramic-coated particles;

leveling out said replacement granules using a granule leveling slide adjustably mounted to an adjustable shingle frame;

compressing said replacement granules into the adhesive base coat with a compressive plate such that the replacement granules are evenly compressed compared to the granules surrounding the area on one or more shingles;

applying a top coat sealant formulation to said area on one or more shingles, said sealant seals the area of the one or more shingles and said top coat sealant formulation being selected from a group consisting of an organic acrylic polymer, an inorganic acrylic polymer, or a co-polymer that bonds all applied materials to the area on one or more shingles.

23. The method of claim 22 further comprising the steps of: positioning an adjustable shingle shield around the perimeter of the area on one or more shingles to isolate said area on one or more shingles from surrounding shingles on the roof before adhesive base coat is applied; and, removing said adjustable shingle shield after said adhesive base coat is applied.

24. The method of claim 23 wherein said shingle shield is adjustable by mechanical adjustment.

25. The method of claim 24 wherein said shingle shield is adjusted by a pin and slot combination assembly.

26. The method of claim 22 further comprising the steps of:

positioning said adjustable shingle frame with one or more slide rails around the area on one or more shingles;

positioning said granule leveling slide on said slide rails of the shingle frame, leveling out granules across the surface of said one or more damaged shingles when actuated with said granule leveling slide, and removing said shingle frame after granule leveling compression.

* * * * *